US010042315B2

(12) United States Patent
Shimizu et al.

(10) Patent No.: US 10,042,315 B2
(45) Date of Patent: Aug. 7, 2018

(54) BLADE AND IMAGE FORMING APPARATUS AND CLEANING DEVICE INCORPORATING SAME

(71) Applicants: Eisuke Shimizu, Tokyo (JP); Kazuhiko Watanabe, Tokyo (JP); Takaaki Tawada, Kanagawa (JP); Yuu Sakakibara, Hokkaido (JP)

(72) Inventors: Eisuke Shimizu, Tokyo (JP); Kazuhiko Watanabe, Tokyo (JP); Takaaki Tawada, Kanagawa (JP); Yuu Sakakibara, Hokkaido (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/219,782

(22) Filed: Jul. 26, 2016

(65) Prior Publication Data

US 2017/0038724 A1 Feb. 9, 2017

(30) Foreign Application Priority Data

Aug. 5, 2015 (JP) ..... 2015-155441

(51) Int. Cl.
*G03G 21/00* (2006.01)

(52) U.S. Cl.
CPC ..... *G03G 21/0017* (2013.01); *G03G 21/0011* (2013.01)

(58) Field of Classification Search
CPC ..... G03G 21/0011; G03G 21/0017
See application file for complete search history.

(56) References Cited

U.S. PATENT DOCUMENTS 6,473,589 B2 * 10/2002 Hisakuni ..... G03G 21/0017 399/350
2004/0213600 A1 10/2004 Watanabe et al.
(Continued)

FOREIGN PATENT DOCUMENTS

JP 2014-240946 12/2014

*Primary Examiner* — Erika J Villaluna
(74) *Attorney, Agent, or Firm* — Oblon, McClelland, Maier & Neustadt, L.L.P.

(57) ABSTRACT

An elastic blade includes a contact edge to contact a contact object, an edge region including the contact edge and having a thickness smaller than or equal to 0.50 mm, and a backup region different in material or property from the edge region. The backup region is adjacent to the edge region on a cross section perpendicular to a direction in which the contact edge extends. The elastic blade has a converted Martens hardness X ($N/mm^2$) in a range of from 0.9 to 2.9. The converted Martens hardness is defined as:

$$X = \frac{S_A}{S_A + S_B} \times h_A + \frac{S_B}{S_A + S_B} \times h_B$$

where $S_A$ represents a cross-sectional area ($mm^2$) of the edge region, $S_B$ represents a cross-sectional area ($mm^2$) of the backup region, $h_A$ represents a Martens hardness ($N/mm^2$) of the edge region, $h_B$ represents a Martens hardness ($N/mm^2$) of the backup region, and t represents the thickness (mm) of the edge region including the contact edge.

11 Claims, 4 Drawing Sheets

(56) References Cited

U.S. PATENT DOCUMENTS

| | | | | |
|---|---|---|---|---|
| 2005/0058474 | A1 | 3/2005 | Watanabe et al. | |
| 2005/0100375 | A1 | 5/2005 | Naruse et al. | |
| 2005/0254868 | A1 | 11/2005 | Naruse et al. | |
| 2006/0099016 | A1 | 5/2006 | Watanabe et al. | |
| 2006/0204259 | A1 | 9/2006 | Watanabe et al. | |
| 2006/0285898 | A1 | 12/2006 | Watanabe et al. | |
| 2007/0003337 | A1 | 1/2007 | Shakuto et al. | |
| 2007/0242992 | A1 | 10/2007 | Watanabe et al. | |
| 2008/0286020 | A1 | 11/2008 | Watanabe et al. | |
| 2014/0161501 | A1 | 6/2014 | Watanabe et al. | |
| 2014/0193172 | A1 | 7/2014 | Tawada et al. | |
| 2014/0341629 | A1 | 11/2014 | Watanabe et al. | |
| 2015/0117896 | A1* | 4/2015 | Sugimoto ..... | G03G 15/161 399/101 |

* cited by examiner

PERIPHERAL LENGTH: C1
PROJECTED AREA: S

AREA: S
PERIPHERAL LENGTH: C2

BLADE AND IMAGE FORMING APPARATUS AND CLEANING DEVICE INCORPORATING SAME

CROSS-REFERENCE TO RELATED APPLICATIONS

This patent application is based on and claims priority pursuant to 35 U.S.C. § 119(a) to Japanese Patent Application No. 2015-155441, filed on Aug. 5, 2015, in the Japan Patent Office, the entire disclosure of which is hereby incorporated by reference herein.

BACKGROUND

Technical Field

Embodiments of the present invention generally relate to a blade, and a clean device including the blade, and an image forming apparatus, such as a copier, a printer, a facsimile machine, or a multifunction peripheral having at least two of copying, printing, facsimile transmission, plotting, and scanning capabilities, that includes the blade.

Description of the Related Art

In electrophotographic image forming apparatuses, after a toner image is transferred from a surface of a photoconductor serving as an image bearer onto a transfer sheet or an intermediate transfer member (e.g., an intermediate transfer belt and an intermediate transfer drum), a cleaning device removes toner remaining (i.e., residual toner) on the surface of the image bearer.

Cleaning devices employing a cleaning blade, shaped like a strip, are widely used for simplicity in structure and high cleaning capability. There are single-layer blades (single-region blades) and multi-layer blades (multi-region blades) used for cleaning.

SUMMARY

In an embodiment, an elastic blade includes a contact edge to contact a contact object, an edge region including the contact edge and having a thickness (t) smaller than or equal to 0.50 mm, and a backup region different in material or property from the edge region. The backup region is adjacent to the edge region on a cross section perpendicular to a direction in which the contact edge extends. The elastic blade has a converted Martens hardness X ($N/mm^2$) in a range of from 0.9 to 2.9, and the converted Martens hardness is defined as:

$$X = \frac{S_A}{S_A + S_B} \times h_A + \frac{S_B}{S_A + S_B} \times h_B$$

where $S_A$ represents a cross-sectional area ($mm^2$) of the edge region, $S_B$ represents a cross-sectional area ($mm^2$) of the backup region, $h_A$ represents a Martens hardness ($N/mm^2$) of the edge region, $h_B$ represents a Martens hardness ($N/mm^2$) of the backup region, and t represents the thickness (mm) of the edge region including the contact edge.

In another embodiment, a cleaning device includes the above-described elastic blade and a spring to press the contact edge of the elastic blade toward the contact object.

In yet another embodiment, an image forming apparatus includes an image bearer to bear an image, a charger to charge a surface of the image bearer, an exposure device to expose the surface of the image bearer to form an electrostatic latent image on the image bearer, a developing device to develop the electrostatic latent image into a toner image, a transfer device to transfer the toner image from the image bearer onto a recording medium, a fixing device to fix the toner image on the recording medium, and the above-described cleaning device to remove residual toner from the image bearer.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
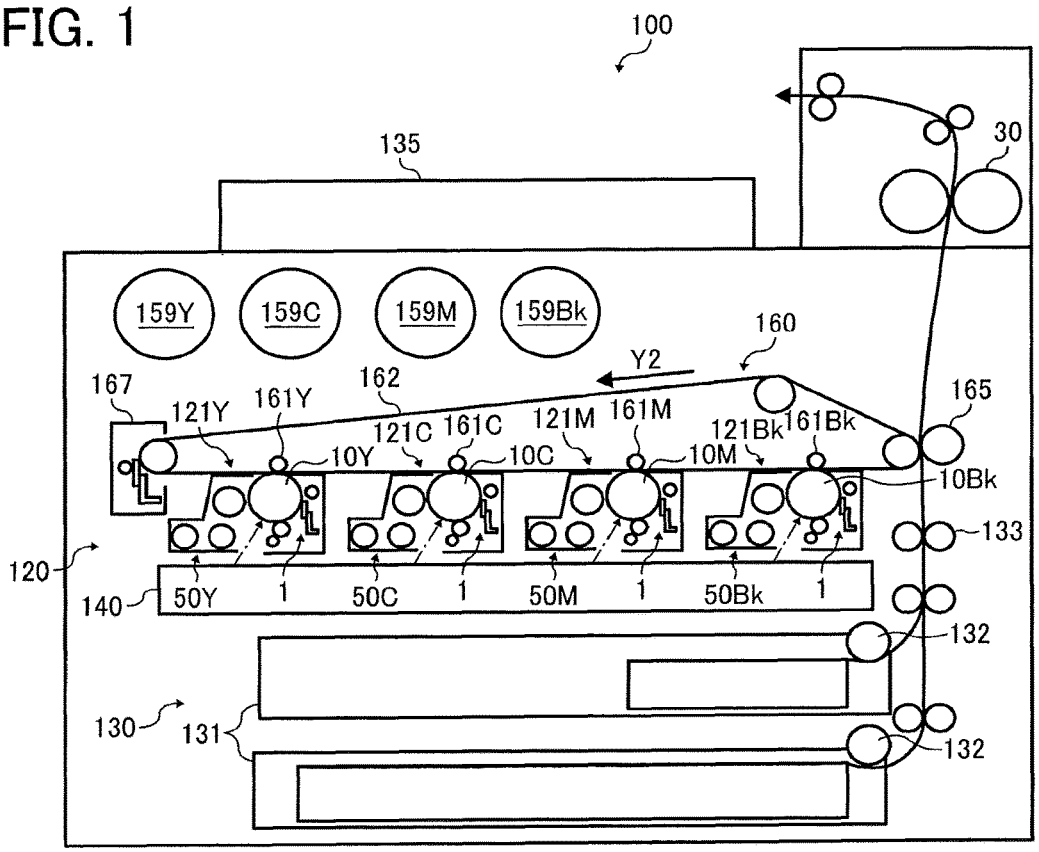
FIG. 1 is a schematic view of an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, descriptions are given below of an electrophotographic printer as an example of an image forming apparatus including a blade according to an embodiment.

FIG. 1 is a schematic diagram of an image forming apparatus 100 according to the present embodiment.

The image forming apparatus 100 is capable of forming multicolor images and includes an image forming unit 120, an intermediate transfer unit 160, and a sheet feeder 130. It is to be noted that subscripts Y, C, M, and Bk represent that components given subscripts Y, C, M, and Bk relate to formation of yellow, magenta, cyan, and black images, respectively.

The image forming unit 120 includes process cartridges 121Y, 121C, 121M, and 121Bk for yellow, cyan, magenta, and black, respectively. The process cartridges 121 (121Y, 121C, 121M, and 121Bk) are arranged in line in a substantially horizontal direction. The process cartridges 121 are removably insertable into the image forming apparatus 100.

The intermediate transfer unit 160 includes an intermediate transfer belt 162, which is an endless belt, primary transfer rollers 161 (161Y, 161C, 161M, and 161Bk), and a secondary transfer roller 165. The intermediate transfer belt 162 is entrained around multiple support rollers. The intermediate transfer belt 162 is positioned above the process cartridges 121 and along the direction in which drum-shaped photoconductors 10Y, 10C, 10M, and 10Bk (i.e., latent image bearers) of the process cartridges 121Y, 121C, 121M, and 121Bk rotate. The intermediate transfer belt 162 rotates in synchronization with the rotation of the photoconductors 10. The primary transfer rollers 161 are positioned along the inner side of the loop of the intermediate transfer belt 162. The primary transfer rollers 161 lightly press the outer face of the intermediate transfer belt 162 against the surfaces of the photoconductors 10.

The process cartridges 121 are similar in configuration and operation to form toner images on the respective photoconductors 10 and transfer the toner images onto the intermediate transfer belt 162. However, the three primary transfer rollers 161Y, 161C, and 161M corresponding to the process cartridges 121Y, 121C, and 121M for colors other than black are movable vertically with a pivot mechanism. The pivot mechanism disengages the intermediate transfer belt 162 from the photoconductors 10Y, 10C, and 10M when multicolor image formation is not performed. Additionally, a belt cleaning device 167 is disposed downstream from the secondary transfer roller 165 and upstream from the process cartridge 121Y in the direction indicated by arrow Y2 illustrated in FIG. 1, in which the intermediate transfer belt 162 rotates.

Above the intermediate transfer unit 160, toner cartridges 159 for the respective process cartridges 121 are disposed side by side in a horizontal or almost horizontal direction. Below the process cartridges 121, an exposure device 140 is disposed to irradiate, with laser beams, the charged surfaces of the photoconductors 10 to form electrostatic latent images thereon.

The sheet feeder 130 is disposed below the exposure device 140. The sheet feeder 130 includes sheet trays 131 for containing sheets of recording media (i.e., transfer sheets) and sheet feeding rollers 132. The sheet feeder 130 feeds transfer sheets to a secondary transfer nip formed between the intermediate transfer belt 162 and the secondary transfer roller 165 via a registration roller pair 133 at a predetermined timing.

A fixing device 30 is disposed downstream from the secondary transfer nip in the direction in which transfer sheets are transported (hereinafter "sheet conveyance direction"). Further, an ejection roller and an output tray 135 to receive transfer sheets discharged are disposed downstream from the fixing device 30 in the sheet conveyance direction.

Figure 2:
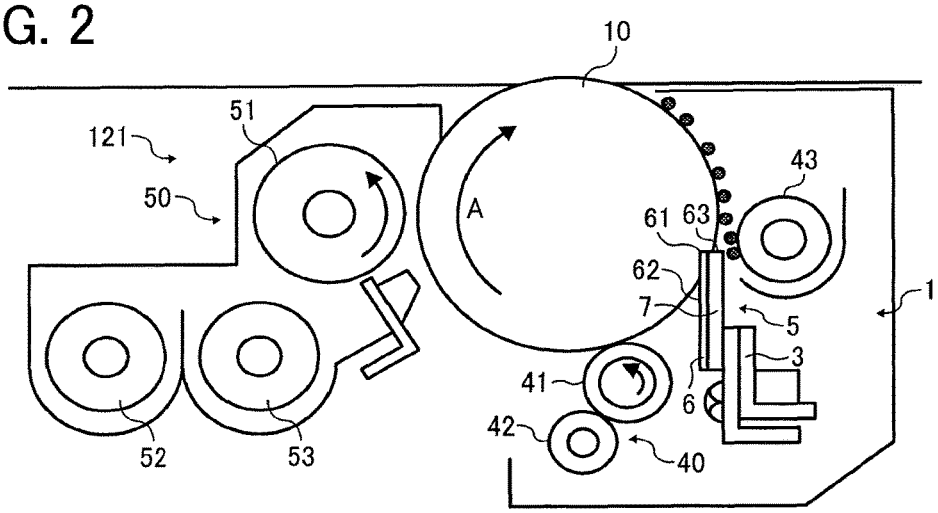
FIG. 2 is a schematic cross-sectional view illustrating a process cartridge installable in the image forming apparatus illustrated in FIG. 1.

FIG. 2 schematically illustrates a configuration of the process cartridge 121 of the image forming apparatus 100. It is to be noted that, in FIG. 2, a cleaning blade of Blade type 2 illustrated in FIG. 3B is illustrated as the cleaning blade 5.

The process cartridges 121 have a similar configuration, and therefore the subscripts Y, C, M, and Bk for color discrimination are omitted when the configuration and operation of the process cartridges 121 are described.

In addition to the drum-shaped photoconductor 10, the process cartridge 121 includes a cleaning device 1, a charging device 40, and a developing device 50 (50Y, 50C, 50M, or 50Bk) disposed around the photoconductor 10.

The cleaning device 1 includes an elastic cleaning blade 5, which is shaped like a strip and extends in the axial direction of the photoconductor 10. The cleaning blade 5 has a multilayer-structure or multi-region structure. An edge 61 (ridgeline) of the cleaning blade 5 extends in a direction perpendicular to the direction of rotation of the photoconductor 10, and the edge 61 is pressed against the surface of the photoconductor 10. The edge 61 serves as a contact edge to contact a contact object. With the edge 61, the cleaning device 1 removes substances, such as residual toner, from the surface of the photoconductor 10. The removed toner is discharged outside cleaning device 1 by a discharge screw 43 of the cleaning device 1.

The charging device 40 includes a charging roller 41 opposing the photoconductor 10 and a roller cleaner 42 that rotates while being in contact with the charging roller 41.

The developing device 50 is designed to supply toner to the surface of the photoconductor 10 to develop the latent image formed thereon into a visible image and includes a developing roller 51 serving as a developer bearer to bear developer including carrier and toner. The developing device 50 includes the developing roller 51, a stirring screw 52, and a supply screw 53. The stirring screw 52 stirs and transports the developer contained in the developing device 50 (in particular, a developer container therein), and the supply screw 53 transports the developer while supplying the agitated developer to the developing roller 51.

The four process cartridges 121 having the above-described configuration can be independently removed from a printer body, installed therein, and replaced by service persons or users. When the process cartridge 121 is removed from the image forming apparatus 100, the photoconductor 10, the charging device 40, the developing device 50, and the cleaning device 1 can be replaced independently. It is to be noted that the process cartridge 121 can further include a waste-toner tank to collect the toner removed by the cleaning device 1. In this case, it is convenient when the waste-toner tank is independently removable, installable, and replaceable.

Next, operation of the image forming apparatus 100 is described below.

The image forming apparatus 100 receives print commands via a control panel of the printer body or from external devices such as computers.

Initially, the photoconductor 10 starts rotating in the direction indicated by arrow A illustrated in FIG. 2, and the charging rollers 41 charge the surfaces of the photoconductors 10 uniformly in a predetermined polarity. The exposure device 140 irradiates the charged photoconductors 10 with laser beams corresponding to respective color data. The laser beams are optically modulated according to multicolor image data input to the image forming apparatus 100. Thus, electrostatic latent images for respective colors are formed on the photoconductors 10. The developing rollers 51 of the developing devices 50 supply respective color toners to the electrostatic latent images, thereby developing the electrostatic latent images into toner images (visible images).

Subsequently, the transfer voltage opposite in polarity to the toner image is given to the primary transfer roller 161, thereby generating a primary transfer electrical field between the photoconductor 10 and the primary transfer roller 161 via the intermediate transfer belt 162. The primary transfer nip is formed by the primary transfer roller 161 lightly nipping (pressing against) the intermediate transfer belt 162. With the transfer electrical field and the nip pressure, the toner images on the respective photoconductors 10 are transferred onto the intermediate transfer belt 162 efficiently (i.e., primary image-transfer). The single-color toner images are superimposed one on another on the intermediate transfer belt 162, forming a multilayer toner image (i.e., multicolor toner image).

Toward the multilayer toner image on the intermediate transfer belt 162, a transfer sheet is timely transported from the sheet tray 131 via the sheet feeding roller 132 and the registration roller pair 133. The secondary transfer roller 165 is given a transfer voltage opposite in polarity to toner images, and a secondary-transfer electrical field is generated between the intermediate transfer belt 162 and the secondary transfer roller 165 via the transfer sheet. The toner image is transferred onto the transfer sheet by the secondary-transfer electrical field (i.e., secondary image-transfer).

The transfer sheet is then transported to the fixing device 30, in which the toner image is fixed on the transfer sheet with heat and pressure. The transfer sheet bearing the fixed toner image is discharged by the ejection roller to the output tray 135.

Meanwhile, the cleaning blades 5 of the cleaning devices 1 removes the toner remaining on the respective photoconductors 10 after the primary image-transfer.

In the configuration illustrated in FIG. 2, the cleaning device 1 includes a blade holder 3 (i.e., a blade support) to support a base end of the cleaning blade 5 such that the edge 61 (the ridgeline or corner at the end opposite the base end) abuts or contacts the surface of the photoconductor 10 (i.e., a contact object). On a cross section (illustrated in FIGS. 2 through 3D) perpendicular to the direction in which the edge 61 extends, the cleaning blade 5 includes an edge region 6, which includes the edge 61, and a backup region 7 different in material or material property from the edge region 6. That is, the cleaning blade 5 illustrated in FIG. 2 is made of or includes a so-called two-region elastic body. The cleaning blade 5 according to the present embodiment is not limited to a double-layer blade (a multi-layered blade) illustrated in FIG. 2.

As illustrated in FIG. 2, an outer face (hereinafter "opposing face 62") starting from the edge 61 and extending in the longitudinal direction of the cleaning blade 5 faces the downstream side in the direction of rotation of the photoconductor 10, indicated by arrow A. An end face 63 at a free end is disposed facing the upstream side in the direction of rotation of the photoconductor 10. The opposing face 62 and the end face 63 are adjacent to each other via the edge 61.

That is, in FIG. 2, the cleaning blade 5 is disposed to contact or abut against the surface of the photoconductor 10 (rotating clockwise in FIG. 2) in the direction counter to the rotation of the photoconductor 10.

It is to be noted that, the following inconveniences can arise regarding a cleaning blade even if the Martens hardness of a blade edge portion of the blade is set to a predetermined value. The inconveniences include a degradation of the capability to follow the shape of the contact object, fatigue of the cleaning blade, and chipping of the edge. Then, there is a risk that a greater amount of substances, such as the residual toner, passes between the contact object and the edge of the cleaning blade, and cleaning capability is degraded.

Specifically, regarding cleaning blades to remove substances adhering to the contact object, as the hardness of the entire cleaning blade increases, the capability to follow the contact object tends to decreases, or the cleaning blade tends to fatigue. By contrast, as the hardness of the entire cleaning blade decreases, there arises a risk of chipping of the edge of the cleaning blade due to stick-slip of the cleaning blade, meaning that the cleaning blade repeatedly sticks to and slips on the contact object.

If a layer-like portion including the edge (i.e., the edge region) is too thick, a high-hardness region is larger. Then, the risk of fatigue of the cleaning blade increases.

The amount of substances, such as the residual toner, passing between the contact object and the edge increases when the capability to follow the contact object (hereinafter "following capability") decreases, the cleaning blade fatigues, or chipping of the edge arises. Thus, cleaning capability is degraded.

In view of the foregoing, descriptions are given below of multiple configurations of the cleaning blade 5 usable in the cleaning device 1 of the image forming apparatus 100 according to the present embodiment.

Embodiment 1

The cleaning blade 5 according to Embodiment 1, usable in the cleaning device 1 of the above-described image forming apparatus 100, is described with reference to the drawings.

Figure 3A:
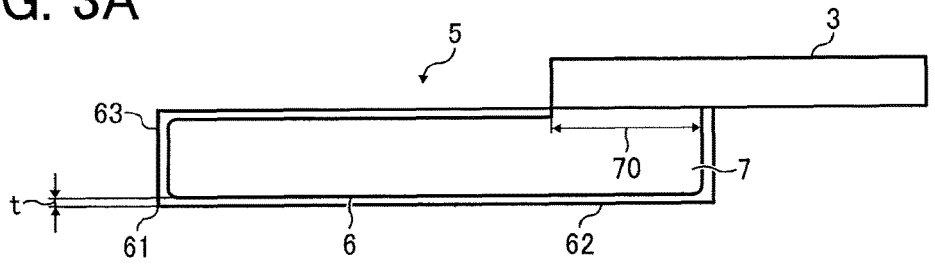
FIGS. 3A, 3B, 3C, and 3D are schematic cross-sectional views of Blade types usable in Embodiment 1.
Figure 3B:
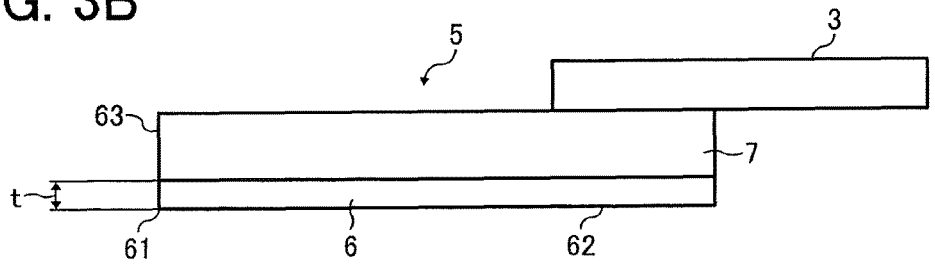
Figure 4:
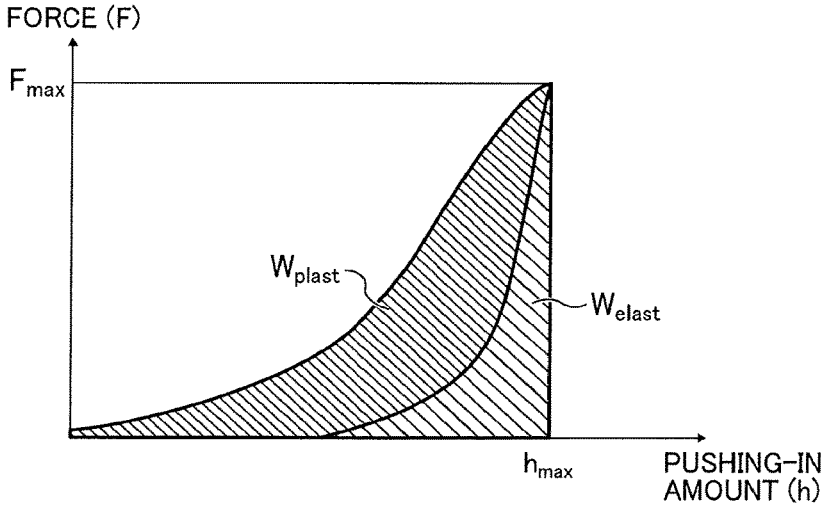
FIG. 4 is a graph of cumulative stress while a Vickers penetrator is pushed in and cumulative stress in removal of a test load.

FIGS. 3A though 3D are schematic views of different cross-sectional structures applicable to the cleaning blade 5 according to Embodiment 1. FIGS. 3A though 3D illustrates cross sections perpendicular to the direction in which the edge 61 extends. FIG. 4 is a graph of cumulative stress while a Vickers penetrator is pushed in, and cumulative stress in removal of a test load.

Figure 3C:
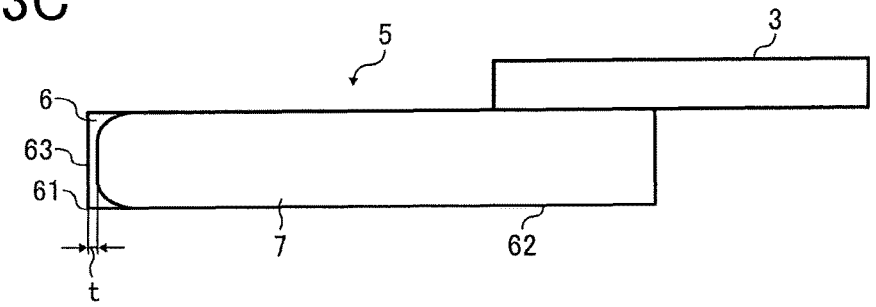
Figure 3D:
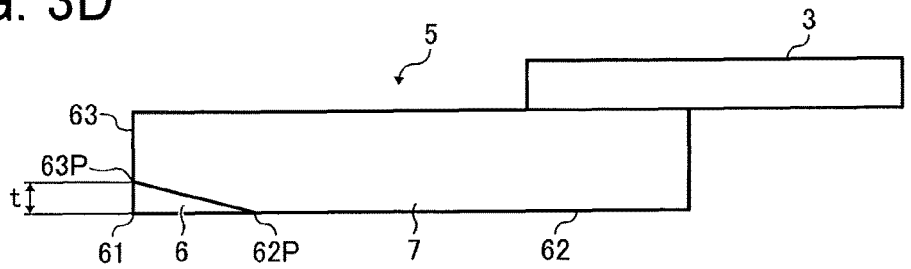

FIG. 3A illustrates Blade type 1, in which the edge region 6 extends along the circumference of the cleaning blade 5 (surrounds the backup region 7) except a connected area 70 connected to the blade holder 3. FIG. 3B illustrates Blade type 2, in which the edge region 6 is a layer disposed along the opposing face 62 facing the photoconductor 10. That is, Blade type 2 is a double-layered blade. FIG. 3C illustrates Blade type 3, in which the edge region 6 extends along the end face 63 including the edge 61 and adjoining the opposing face 62. FIG. 3D illustrates Blade type 4, in which the edge region 6 is a triangular region defined by the edge 61, a point 63P on the end face 63, and a point 62P on the opposing face 62.

As described above, the cleaning blade 5 is an elastic body including the edge region 6 and the backup region 7, on the cross section perpendicular to the direction in which the edge 61 extends. The edge region 6 includes the edge 61, and the backup region 7 is different in material or material property from the edge region 6.

In the cleaning blade 5 according to the present embodiment, the edge region 6 and the backup region 7 are configured so that a converted Martens hardness X is greater than or equal to 0.9 newtons per square millimeter ($N/mm^2$) and smaller than or equal to 2.9 $N/mm^2$ (i.e., in a range of from 0.9 $N/mm^2$ to 2.9 $N/mm^2$). The converted Martens hardness X is defined by $$X = \frac{S_A}{S_A + S_B} \times h_A + \frac{S_B}{S_A + S_B} \times h_B, \qquad \text{Formula 1}$$

where X represents the converted Martens hardness ($N/mm^2$), $S_A$ represents the cross-sectional area ($mm^2$) of the edge region 6, $S_B$ represents the cross-sectional area ($mm^2$) of the backup region 7, $h_A$ represents the Martens hardness ($N/mm^2$) of the edge region 6, $h_B$ represents the Martens hardness ($N/mm^2$) of the backup region 7, and t represents the thickness of the layer-like portion including the edge 61.

Additionally, in the edge region 6, a layer-like portion including the edge 61 has a thickness t (illustrated in FIGS. 3A through 3D) of smaller than or equal to 0.5 millimeters (mm).

It is to be noted that the layer-like portion including the edge 61, defied for each of Blade types 1 through 4 as illustrated in FIGS. 3A through 3D, has the above-defined thickness t in the state in which the cleaning blade 5 is not deformed.

Specifically, regarding Blade type 1, the edge region 6 extends along the circumference of the cleaning blade 5 on the cross section illustrated in FIG. 3A and includes a layer-like portion on an opposing-face side (opposing the photoconductor 10) and another layer-like portion on an end-face side. Each of the layer-like portion has the thickness t. In FIG. 3A, a leader line of the reference "t" is given to the thickness of the layer-like portion (i.e., a rectangular portion) including the edge 61 and the opposing face 62 (i,e., a depth from the opposing face 62). The layer-like portion extending on the end-face side is the rectangular portion including the end face 63.

In Blade type 2 illustrated in FIG. 3B, the edge region 6 shaped like a layer extending along the opposing face 62 (to face the photoconductor 10) has the thickness t.

In Blade type 3 illustrated in FIG. 3C, the edge region 6 includes the edge 61 and the end face 63 (adjacent to the opposing face 62) and has the thickness t as a depth from the end face 63.

In Blade type 4 illustrated in FIG. 3D, the triangular edge region 6 defined by the edge 61, the point 63P on the end face 63, and the point 62P on the opposing face 62 has the thickness t, which is a length along the end face 63 on the cross section perpendicular to the direction in which the edge 61 extends.

For example, an elastic material, such as urethane rubber, is usable for the edge region 6 and the backup region 7 of the cleaning blade 5.

The value X of the converted Martens hardness defined by Formula 1 serves as an index of hardness of the entire two-region cleaning blade 5.

When the converted Martens hardness X is greater than or equal to 0.9 N/mm$^2$ and smaller than or equal to 2.9 N/mm$^2$, the hardness of the entire cleaning blade 5 can be in the range to suppress the degradation of the following capability and the fatigue over time of cleaning blade 5, which occur when the hardness of the cleaning blade 5 is relatively high. Simultaneously, the hardness of the entire cleaning blade 5 can be in the range to suppress the risk of chipping of the edge 61 of the cleaning blade due to stick-slip, which occurs when the hardness of the cleaning blade 5 is relatively low.

Further, when the thickness t of the layer-like portion including the edge 61 is smaller than or equal to 0.50 mm (500 μm), the percentage of the high-hardness region is limited, thereby reducing the risk of the fatigue of the cleaning blade 5.

This configuration can inhibit the substances, such as the residual toner, from passing between the photoconductor 10 and the edge 61 of the cleaning blade 5 and accordingly inhibit the degradation of the cleaning capability, Next, a verification experiment performed to ascertain effects of the cleaning blade 5 according to the present embodiment is described.

The Martens hardness and the elastic power of the regions of the cleaning blade 5 are measured as described below.

The Martens hardness and the elastic power of the edge region 6 mentioned above were obtained using a micro hardness measuring system, FISCHERSCOPE® HM2000, from Fischer Technology, Inc.

Push a Vickers penetrator in the cleaning blade 5 at 20 μm from the edge 61 (ridgeline at the end), with a strength of 1.0 mN for 10 seconds, keep that state for 5 seconds, and gradually draw out the Vickers penetrator in 10 seconds. Then, measure the Martens hardness of the edge region 6. Concurrently with measurement of the Martens hardness, the elastic power is calculated.

The elastic power is a characteristic value defined as:

$$W_{elast}/W_{plast}\times 100\%,$$

where $W_{plast}$ represents the cumulative stress caused while the Vickers penetrator is pushed in, and $W_{elast}$ represents cumulative stress caused in removal of the test load (see FIG. 4).

As the elastic power increases, the rate of plastic work in the period from application of force to distort the material to remove the load becomes smaller. That is, the rate of plastic deformation in the deformation of rubber caused by force is smaller.

Multiple configurations of the cleaning blade 5 according to the present embodiment and comparative examples, used in the verification experiment, and verification results thereof are specified in Table 1 below.

It is to be noted that the numerals in column "Blade type" in Table 1 correspond to Blade types 1 through 4 illustrated in FIGS. 3A through 3D.

TABLE 1

| | Blade type | X | $S_A$ [mm$^2$] | $S_B$ [mm$^2$] | $h_A$ | $h_B$ | t [mm] | Cleaning capability |
|---|---|---|---|---|---|---|---|---|
| Configuration 1 | 1 | 0.9 | 4.9 | 17.6 | 1.8 | 0.7 | 0.17 | Excellent |
| Configuration 2 | 2 | 0.9 | 5.6 | 16.3 | 1.5 | 0.7 | 0.45 | Excellent |
| Configuration 3 | 2 | 0.9 | 6.3 | 16.3 | 1.5 | 0.7 | 0.50 | Excellent |
| Configuration 4 | 3 | 0.9 | 0.2 | 22.3 | 5.0 | 0.9 | 0.09 | Excellent |
| Configuration 5 | 4 | 0.9 | 0.2 | 22.3 | 5.0 | 0.9 | 0.09 | Excellent |
| Configuration 6 | 1 | 1.3 | 5.8 | 16.8 | 3.0 | 0.7 | 0.20 | Excellent |
| Configuration 7 | 2 | 1.0 | 5.6 | 16.3 | 2.0 | 0.7 | 0.45 | Excellent |
| Configuration 8 | 2 | 1.1 | 6.3 | 16.3 | 2.0 | 0.7 | 0.50 | Excellent |
| Configuration 9 | 3 | 1.0 | 0.2 | 22.3 | 5.0 | 1.0 | 0.10 | Excellent |
| Configuration 10 | 4 | 1.0 | 0.2 | 22.3 | 5.0 | 1.0 | 0.10 | Excellent |
| Configuration 11 | 1 | 1.9 | 5.8 | 16.8 | 3.0 | 1.5 | 0.20 | Good |
| Configuration 12 | 2 | 1.6 | 5.6 | 16.3 | 2.0 | 1.5 | 0.45 | Good |
| Configuration 13 | 2 | 1.6 | 6.3 | 16.3 | 2.0 | 1.5 | 0.50 | Good |
| Configuration 14 | 3 | 1.5 | 0.2 | 22.3 | 5.0 | 1.5 | 0.10 | Good |
| Configuration 15 | 4 | 1.5 | 0.2 | 22.3 | 5.0 | 1.5 | 0.10 | Good |
| Configuration 16 | 1 | 2.9 | 5.8 | 16.8 | 5.0 | 2.2 | 0.20 | Acceptable |
| Configuration 17 | 2 | 2.9 | 5.6 | 16.3 | 5.0 | 2.2 | 0.45 | Acceptable |
| Configuration 18 | 2 | 2.9 | 6.3 | 16.3 | 5.0 | 2.1 | 0.50 | Acceptable |
| Configuration 19 | 3 | 2.9 | 0.2 | 22.3 | 5.0 | 2.9 | 0.10 | Acceptable |
| Configuration 20 | 4 | 2.9 | 0.2 | 22.3 | 5.0 | 2.9 | 0.10 | Acceptable |
| Comparative example 1 | 1 | 4.3 | 5.8 | 16.8 | 8.0 | 3.0 | 0.20 | Poor |
| Comparative example 2 | 2 | 3.6 | 5.6 | 16.3 | 7.5 | 2.3 | 0.45 | Poor |
| Comparative example 3 | 2 | 3.6 | 6.3 | 16.3 | 7.0 | 2.3 | 0.50 | Poor |
| Comparative | 3 | 3.5 | 0.2 | 22.3 | 9.0 | 3.5 | 0.10 | Poor |

TABLE 1-continued

| | Blade type | X | $S_A$ [mm$^2$] | $S_B$ [mm$^2$] | $h_A$ | $h_B$ | t [mm] | Cleaning capability |
|---|---|---|---|---|---|---|---|---|
| example 4 | | | | | | | | |
| Comparative example 5 | 4 | 3.5 | 0.2 | 22.3 | 9.0 | 3.5 | 0.10 | Poor |
| Comparative example 6 | 1 | 2.4 | 15.8 | 6.7 | 3.0 | 1.0 | 0.55 | Poor |
| Comparative example 7 | 2 | 2.1 | 6.9 | 22.5 | 5.0 | 1.2 | 0.55 | Poor |
| Comparative example 8 | 3 | 2.3 | 1.0 | 21.5 | 8.0 | 2.0 | 0.55 | Poor |
| Comparative example 9 | 4 | 2.3 | 1.1 | 21.4 | 8.0 | 2.0 | 0.55 | Poor |
| Comparative example 10 | 1 | 2.5 | 17.3 | 5.3 | 3.0 | 1.0 | 0.60 | Poor |
| Comparative example 11 | 2 | 2.0 | 7.5 | 22.5 | 5.0 | 1.0 | 0.60 | Poor |
| Comparative example 12 | 3 | 2.3 | 1.1 | 21.4 | 8.0 | 2.0 | 0.60 | Poor |
| Comparative example 13 | 4 | 2.3 | 1.2 | 21.3 | 8.0 | 2.0 | 0.60 | Poor |
| Comparative example 14 | 2 | 3.1 | 12.5 | 11.3 | 5.0 | 1.0 | 1.00 | Poor |
| Comparative example 15 | 3 | 2.5 | 1.8 | 20.7 | 8.0 | 2.0 | 1.00 | Poor |
| Comparative example 16 | 4 | 2.5 | 2.0 | 20.5 | 8.0 | 2.0 | 1.00 | Poor |

[Evaluation Method]

(Cleaning Capability)

The cleaning capability was evaluated under the following conditions.

As a test machine (an image forming apparatus), Ricoh PC 3503 was used. In the test machine, the cleaning blade 5 of the process cartridge 121 illustrated in FIG. 2 was replaced with each of the cleaning blades according to Configurations 1 through 12 and Comparative examples 1 through 4 listed in Table 1.

The test machine was left unused for 24 hours in a cold environment (10° C.), and then images were successively output on 10,000 sheets. To input a greater amount of toner to the photoconductor 10 (an image bearer), a solid image extending entirely in A4 size was output.

The cleaning capability was evaluated in the following manner and rated in four grades of "Excellent", "Good", "Acceptable", and "Poor".

Excellent: No trace of defective cleaning is observed on the transfer sheet after feeding of 10,000 sheets. There is no practical disadvantage. Defective cleaning does not occur even under a severe condition in which the charging current is increased, which is a harsh condition for cleaning.

Good: After output of 10,000 sheets, the trace of defective cleaning is not observed on the transfer sheets, and practically there are no problems.

Acceptable: No trace of defective cleaning is observed on the transfer sheets after output of 10,000 sheets. There is no practical disadvantage. However, toner escaping the cleaning blade 5 on the photoconductor 10 is observed.

Poor: After output of 10,000 sheets, the trace of defective cleaning is observed on the transfer sheets, and the outputs images are practically substandard.

[Evaluation Results]

(Configuration 1)

Configuration 1 employs Blade type 1 illustrated in FIG. 3A. The cross-sectional area $S_A$ of the edge region 6 including the edge 61 is 4.9 mm$^2$, and the cross-sectional area $S_B$ of the backup region 7 (other than the edge region 6) is 17.6 mm$^2$. The Martens hardness $h_A$ of the edge region 6 is 1.8 N/mm$^2$, and the Martens hardness $h_B$ of the backup region 7 is 0.7 N/mm$^2$. The converted Martens hardness X calculated according to Formula 1 is 0.9 N/mm$^2$.

The thickness t of the layer-like portion including the edge 61 is 0.17 mm.

The converted Martens hardness X is within the range of from 0.9 N/mm$^2$ to 2.9 N/mm$^2$, and the thickness t satisfies the specified range (smaller than or equal to 0.50 mm). Cleaning capability was rated as excellent. That is, defective cleaning did not occur.

(Configurations 2 through 20)

Similar to Configuration 1, the converted Martens hardness X is within the range of from 0.9 N/mm$^2$ to 2.9 N/mm$^2$, and the thickness t of the layer-like portion including the edge 61, defined for each Blade type, is smaller than or equal to 0.50 mm.

Cleaning capability was rated as excellent, good, or acceptable. No trace of defective cleaning was observed on the transfer sheet, and defective cleaning did not occur.

Comparative Examples 1 Through 5

Differently from Configuration 1 through 20, the converted Martens hardness X calculated according to Formula 1 is greater than 2.9 N/mm$^2$, that is, out of the range of from 0.9 N/mm$^2$ to 2.9 N/mm$^2$.

As described above, due to the backup region 7 being higher in hardness than the edge region 6, the cleaning blade according to Comparative examples 1 through 5 has a reduced capability to follow the surface unevenness of the photoconductor 10. Then, toner escapes the cleaning blade 5. Since the hardness of the cleaning blade 5 is relatively low, there is the risk of chipping of the edge 61 due to the stick-slip. Therefore, cleaning capability deteriorated and was rated as poor. That is, defective cleaning was obvious on the transfer sheet.

Comparative Examples 6 Through 16

Differently from Configurations 1 through 20, the thickness t of the layer-like portion including the edge 61, defined for each Blade type, is greater than 0.50 mm (500 μm).

As described above, when the layer-like portion including the edge 61 is thicker than the specified range, in the behavior of the cleaning blade 5, the percentage of contribution of the layer-like portion including the edge 61 increases. Accordingly, when the portion including the edge 61 has a relatively high hardness, the cleaning blade 5 fatigues. Then, the line pressure (contact pressure) decreases, thus increasing the possibility of defective cleaning. When the portion including the edge 61 has a relatively low hardness, the entire cleaning blade 5 deforms due to the sliding contact with the photoconductor 10, and the amount of toner escaping the cleaning blade 5 increases. Then, the cleaning capability decreases. Therefore, the cleaning capability was rated as poor. That is, defective cleaning was obvious on the transfer sheet.

The above-described verification results confirm that degradation of the capability to remove adhering substances from the photoconductor 10 is suppressed when the converted Martens hardness X defined by Formula 1 is in the range of from 0.9 N/mm$^2$ to 2.9 N/mm$^2$ and the thickness t of the layer-like portion including the edge 61 is smaller than or equal to 0.5 mm.

When the elastic power of the edge region 6 and the elastic power of the backup region 7 are low (the ratio of plastic work to deformation is greater), permanent deformation of the cleaning blade 5 easily arises. Then, the permanent deformation of the cleaning blade 5 causes fatigue of the cleaning blade 5, and the contact pressure (line pressure) of the edge 61 (blade edge) pressed to the photoconductor 10 decreases. Then, defective cleaning occurs easily.

In the present embodiment, the elastic power of the edge region 6 is greater than or equal to 40% and smaller than or equal to 90% (i.e., a range of from 40% to 90%), and the elastic power of the backup region 7 is greater than or equal to 70% and smaller than or equal to 95% (i.e., a range of from 70% to 95%).

Such elastic power ranges are advantageous in inhibiting the line pressure from significantly decreasing to a degree to degrade the cleaning capability and makes the deformation of the entire cleaning blade 5 not plastic but elastic. Accordingly, fatigue of the cleaning blade 5 is suppressed.

Embodiment 2

Embodiment 2 of the cleaning blade 5 usable in the cleaning device 1 of the above-described image forming apparatus 100 is described.

It is to be noted that the cleaning blade 5 according to present embodiment is different from the cleaning blade 5 according Embodiment 1 in that the relation between the Martens hardness $h_A$ of the edge region 6 and the Martens hardness hp of the backup region 7 is specified.

Redundant descriptions about structures similar to Embodiment 1 and action and effects thereof are omitted. Unless it is necessary to distinguish, the same reference characters are given to the same or similar elements in the descriptions below.

When the backup region 7 is higher in hardness than the edge region 6, the capability of the cleaning blade 5 to follow the surface unevenness of the photoconductor 10 is degraded. Then, there is the risk that toner escapes the cleaning blade 5, that is, passes through the clearance between the photoconductor 10 and the edge 61. When the edge 61 (included in the edge region 6) is lower in hardness than the backup region 7, there is the risk of chipping of the edge 61 due to the stick-slip.

In view of the foregoing, in the cleaning blade 5 according to the present embodiment, the Martens hardness $h_A$ of the edge region 6 is greater than the Martens hardness $h_B$ of the backup region 7 ($h_A > h_B$).

When the edge region 6 is higher in hardness than the backup region 7, chipping of the edge 61 due to the stick-slip is inhibited.

Next, a verification experiment performed to ascertain effects of the cleaning blade 5 according to the present embodiment is described.

The Martens hardness of each region was measured in a manner similar to that in Embodiment 1.

Multiple configurations of the cleaning blade 5 according to the present embodiment and comparative examples, used in the verification experiment, and verification results thereof are specified in Table 2 below.

TABLE 2

| | Blade type | X | $S_A$ [mm$^2$] | $S_B$ [mm$^2$] | $h_A$ | $h_B$ | t [mm] | Cleaning capability |
|---|---|---|---|---|---|---|---|---|
| Configuration 1 | 1 | 1.2 | 4.9 | 17.6 | 3.0 | 0.7 | 0.17 | Excellent |
| Configuration 2 | 2 | 1.3 | 5.6 | 16.3 | 3.0 | 0.7 | 0.45 | Excellent |
| Configuration 3 | 2 | 1.3 | 6.3 | 16.3 | 3.0 | 0.7 | 0.50 | Excellent |

TABLE 2-continued

| | Blade type | X | $S_A$ [mm$^2$] | $S_B$ [mm$^2$] | $h_A$ | $h_B$ | t [mm] | Cleaning capability |
|---|---|---|---|---|---|---|---|---|
| Configuration 4 | 3 | 0.9 | 0.2 | 22.3 | 5.0 | 0.9 | 0.09 | Excellent |
| Configuration 5 | 4 | 0.9 | 0.2 | 22.3 | 5.0 | 0.9 | 0.09 | Excellent |
| Configuration 6 | 1 | 1.1 | 4.9 | 17.6 | 2.0 | 0.9 | 0.17 | Good |
| Configuration 7 | 2 | 1.0 | 5.6 | 16.3 | 2.0 | 0.7 | 0.45 | Good |
| Configuration 8 | 2 | 1.1 | 6.3 | 16.3 | 2.0 | 0.7 | 0.50 | Good |
| Configuration 9 | 3 | 1.0 | 0.2 | 22.3 | 2.0 | 1.0 | 0.09 | Good |
| Configuration 10 | 4 | 1.0 | 0.2 | 22.3 | 2.0 | 1.0 | 0.09 | Good |
| Comparative example 1 | 1 | 2.7 | 4.9 | 17.6 | 1.5 | 3.0 | 0.17 | Poor |
| Comparative example 2 | 2 | 2.6 | 5.6 | 16.3 | 1.5 | 3.0 | 0.45 | Poor |
| Comparative example 3 | 2 | 2.6 | 6.3 | 16.3 | 1.5 | 3.0 | 0.50 | Poor |
| Comparative example 4 | 3 | 2.9 | 0.2 | 22.3 | 1.5 | 2.9 | 0.09 | Poor |
| Comparative example 5 | 4 | 2.9 | 0.2 | 22.3 | 1.5 | 2.9 | 0.09 | Poor |

[Evaluation Method]

(Cleaning Capability)

The cleaning capability was evaluated under the following conditions.

As a test machine (an image forming apparatus), Ricoh PC 3503 was used. In the test machine, the cleaning blade 5 of the process cartridge 121 illustrated in FIG. 2 was replaced with each of the cleaning blades according to Configurations 1 through 10 and Comparative examples 1 through 5 specified in Table 2.

The test machine was left unused for 24 hours in the cold environment (10° C.), and then images were successively output on 30,000 sheets. To input a greater amount of toner to the photoconductor 10 (an image bearer), a solid image extending entirely in A4 size was output.

The cleaning capability was evaluated in the following manner and rated in four grades of "Excellent", "Good", "Acceptable", and "Poor".

Excellent: No trace of defective cleaning is observed on the transfer sheet after feeding of 30,000 sheets. There is no practical disadvantage. Defective cleaning does not occur even under a severe condition in which the charging current is increased, which is a harsh condition for cleaning.

Good: After output of 30,000 sheets, the trace of defective cleaning is not observed on the transfer sheets, and practically there are no problems.

Acceptable: No trace of defective cleaning is observed on the transfer sheets after output of 30,000 sheets. Although there is no practical disadvantage, toner escaping the cleaning blade 5 on the photoconductor 10 is observed with eyes.

Poor: After output of 30,000 sheets, the trace of defective cleaning is observed on the transfer sheets, and the outputs images are practically substandard.

[Evaluation Results]

(Configuration 1)

Configuration 1 employs Blade type 1 illustrated in FIG. 3A. The cross-sectional area $S_A$ of the edge region 6 including the edge 61 is 4.9 mm$^2$, and the cross-sectional area $S_B$ of the backup region 7 (does not include the edge 61) is 17.6 mm$^2$. The Martens hardness $h_A$ of the edge region 6 is 3.0 N/mm$^2$, and the Martens hardness $h_B$ of the backup region 7 is 0.7 N/mm$^2$. The converted Martens hardness X calculated according to Formula 1 is 1.2 N/mm$^2$.

The thickness t of the layer-like portion including the edge 61 is 0.17 mm. The converted Martens hardness X is within the range of from 0.9 N/mm$^2$ to 2.9 N/mm$^2$, and the thickness t is not greater than 0.50 mm. The Martens hardness $h_A$ of the edge region 6 is greater than the Martens hardness $h_B$ of the backup region 7, which does not includes the edge 61.

Cleaning capability was rated as excellent. That is, defective cleaning did not occur.

(Configurations 2 through 10)

Similar to Configuration 1, the converted Martens hardness X is within the range of from 0.9 N/mm$^2$ to 2.9 N/mm$^2$, and the thickness t of the layer-like portion including the edge 61, defined for each Blade type, is smaller than or equal to 0.50 mm. The Martens hardness $h_A$ of the edge region 6 is greater than the Martens hardness $h_B$ of the backup region 7, which does not includes the edge 61.

Cleaning capability was rated as excellent or good. No trace of defective cleaning was observed on the transfer sheet, and defective cleaning did not occur.

Comparative Examples 1 Through 5

Differently from Configurations 1 through 10, the Martens hardness $h_A$ of the edge region 6, which includes the edge 61, is smaller than the Martens hardness $h_B$ of the backup region 7, which does not includes the edge 61.

As described above, due to the backup region 7 being higher in hardness than the edge region 6, the capability to follow the surface unevenness of the photoconductor 10 is reduced in Comparative examples 1 through 5. Then, toner escapes the cleaning blade. Since the hardness of the cleaning blade 5 is relatively low, there is the risk of chipping of the edge 61 due to the stick-slip. Therefore, cleaning capability deteriorated and was rated as poor. That is, defective cleaning was obvious on the transfer sheet.

The above-described evaluation results confirm that, when the cleaning blade 5 has the feature that the edge region 6 is higher in hardness than the backup region 7, as well as the features of Embodiment 1, toner escaping and chipping of the edge 61 due to the stick-slip are inhibited.

Embodiment 3

Embodiment 3 of the cleaning blade 5 usable in the cleaning device 1 of the above-described image forming apparatus 100 is described.

The cleaning blade 5 according to Embodiment 3 is different from the cleaning blade 5 according to Embodiment 1 or 2 in that the minimum of the Martens hardness $h_A$ of the edge region 6 is specified.

Redundant descriptions about structures similar to Embodiment 1 or 2 and action and effects thereof are omitted. Unless it is necessary to distinguish, the same reference characters are given to the same or similar elements in the descriptions below.

When the Martens hardness $h_A$ of the edge 61 included in the edge region 6 is lower than 1.5 N/mm$^2$, it is possible that the substances (e.g., toner and external additives) adhere to the edge 61, and the substances solidify on the photoconductor 10 over time. Such solidification on the photoconductor 10 can cause image failure such as streaky voids (like small fishes dispersed in output images) and filming.

In view of the foregoing, in the cleaning blade 5 according to the present embodiment, the Martens hardness $h_A$ of the edge region 6 is greater than or equal to 1.5 N/mm$^2$ to suppress the image failures, such as streaky voids and filming, caused by solidification of the substances on the surface of the photoconductor 10.

Next, a verification experiment performed to ascertain effects of the cleaning blade 5 according to the present embodiment is described.

Measurement of the Martens hardness was similar to that in Embodiments 1 and 2.

Multiple configurations of the cleaning blade 5 according to the present embodiment and comparative examples, used in the verification experiment, and verification results thereof are specified in Table 3 below.

TABLE 3

| | Blade type | X | $S_A$ [mm$^2$] | $S_B$ [mm$^2$] | $h_A$ | $h_B$ | t [mm] | Cleaning capability |
|---|---|---|---|---|---|---|---|---|
| Configuration 1 | 1 | 1.2 | 4.9 | 17.6 | 3.0 | 0.7 | 0.17 | Excellent |
| Configuration 2 | 2 | 1.3 | 5.6 | 16.3 | 3.0 | 0.7 | 0.45 | Excellent |
| Configuration 3 | 2 | 1.3 | 6.3 | 16.3 | 3.0 | 0.7 | 0.50 | Excellent |
| Configuration 4 | 3 | 0.9 | 0.2 | 22.3 | 5.0 | 0.9 | 0.09 | Excellent |
| Configuration 5 | 4 | 0.9 | 0.2 | 22.3 | 5.0 | 0.9 | 0.09 | Excellent |
| Configuration 6 | 1 | 1.1 | 4.9 | 17.6 | 2.0 | 0.9 | 0.17 | Good |
| Configuration 7 | 2 | 1.0 | 5.6 | 16.3 | 2.0 | 0.7 | 0.45 | Good |
| Configuration 8 | 2 | 1.1 | 6.3 | 16.3 | 2.0 | 0.7 | 0.50 | Good |
| Configuration 9 | 3 | 1.0 | 0.2 | 22.3 | 2.0 | 1.0 | 0.09 | Good |
| Configuration 10 | 4 | 1.0 | 0.2 | 22.3 | 2.0 | 1.0 | 0.09 | Good |
| Configuration 11 | 1 | 1.0 | 4.9 | 17.6 | 1.5 | 0.8 | 0.17 | Acceptable |
| Configuration 12 | 2 | 0.9 | 5.6 | 16.3 | 1.5 | 0.7 | 0.45 | Acceptable |
| Configuration 13 | 2 | 0.9 | 6.3 | 16.3 | 1.5 | 0.7 | 0.50 | Acceptable |
| Configuration 14 | 3 | 0.9 | 0.2 | 22.3 | 1.5 | 0.9 | 0.09 | Acceptable |
| Configuration 15 | 4 | 0.9 | 0.2 | 22.3 | 1.5 | 0.9 | 0.09 | Acceptable |
| Comparative example 1 | 1 | 0.8 | 4.9 | 17.6 | 0.9 | 0.8 | 0.17 | Poor |
| Comparative example 2 | 2 | 0.7 | 5.6 | 16.3 | 0.8 | 0.7 | 0.45 | Poor |
| Comparative example 3 | 2 | 0.7 | 6.3 | 16.3 | 0.8 | 0.7 | 0.50 | Poor |
| Comparative example 4 | 3 | 0.9 | 0.2 | 22.3 | 1.0 | 0.9 | 0.09 | Poor |
| Comparative example 5 | 4 | 0.9 | 0.2 | 22.3 | 1.0 | 0.9 | 0.09 | Poor |

[Evaluation Method]

Evaluation of Streaky Voids and Filming

The inhibition of streaky voids and filming was evaluated under the following conditions.

As a test machine (an image forming apparatus), Ricoh PC 3503 was used. In the test machine, the cleaning blade 5 of the process cartridge 121 illustrated in FIG. 2 was replaced with each of the cleaning blades according to Configurations 1 through 15 and Comparative examples 1 through 5 specified in Table 3.

Images were output on 20,000 sheets consecutively under a temperature of 32° C. and a humidity of 54%. As output images, an image having an image area ratio of 5% was output on A4-size transfer sheets.

The cleaning capability was evaluated in the following manner and rated in four grades of "Excellent", "Good", "Acceptable", and "Poor". Excellent: The trace of filming on the output images is not observed with eyes after feeding of 20,000 sheets, and image failure is not recognized. Toner external additives rarely remain on the photoconductor 10.

Acceptable: No trace of filming is observed on the output images with eyes, and image failure is not recognized. The amount of external additives adhering to the photoconductor 10 is small.

Acceptable: No trace of filming is observed on the output images with eyes after feeding of 20,000 sheets. Although image failure is not recognized on the output images, adhesion of external additives to the photoconductor 10 is noticeable.

Poor: The trace of filming on the output images is observed with eyes after feeding of 20,000 sheets, and the image is substandard.

[Evaluation Results]

(Configuration 1)

Configuration 1 employs Blade type 1 illustrated in FIG. 3A. The cross-sectional area $S_A$ of the edge region 6 including the edge 61 is 4.9 $mm^2$, and the cross-sectional area $S_B$ of the backup region 7 (does not include the edge 61) is 17.6 $mm^2$. The Martens hardness $h_A$ of the edge region 6 is 3.0 $N/mm^2$, and the Martens hardness $h_B$ of the backup region 7 is 0.7 $N/mm^2$. The converted Martens hardness X calculated according to Formula 1 is 1.2 $N/mm^2$.

The thickness t of the layer-like portion including the edge 61 is 0.17 mm.

The converted Martens hardness X is within the range of from 0.9 $N/mm^2$ to 2.9 $N/mm^2$, and the thickness t is not greater than 0.50 mm. The Martens hardness $h_A$ of the edge region 6, which includes the edge 61, satisfies the range specified in Embodiment 3 (greater than or equal to 1.5 $N/mm^2$).

Inhibition of streaky voids and filming is evaluated as excellent. That is, streaky voids and filming were not observed after feeding of 20,000 sheets.

(Configurations 2 through 15)

Similar to Configuration 1, the converted Martens hardness X is within the range of from 0.9 $N/mm^2$ to 2.9 $N/mm^2$, and the thickness t of the layer-like portion including the edge 61 is smaller than or equal to 0.50 mm. The Martens hardness $h_A$ of the edge region 6 is greater than the Martens hardness $h_B$ of the backup region 7, which does not includes the edge 61. The Martens hardness $h_A$ of the edge region 6 satisfies the range specified in Embodiment 3 (greater than or equal to 1.5 $N/mm^2$).

Inhibition of streaky voids and filming is evaluated as good or acceptable. That is, streaky voids and filming were not observed after feeding of 20,000 sheets.

Comparative Examples 1 Through 5

Unlike Configurations 1 through 15, the Martens hardness $h_A$ of the edge region 6 including the edge 61 is smaller than 1.5 $N/mm^2$.

Due to the Martens hardness $h_A$ of the edge region 6 being smaller than 1.5 $N/mm^2$, the substances (e.g. toner and external additives) adhered to the surface of the photoconductor 10 solidified thereon over time. Consequently, image failure such as streaky voids and filming occurred.

The above verification results confirm that the combination of the features of Embodiments 1 and 2 and the feature that the Martens hardness $h_A$ of the edge region 6 is greater than or equal to 1.5 $N/mm^2$ is advantageous in inhibiting the image failure such as streaky voids and filming caused by the adhering substances, which solidifies on the photoconductor 10 over time.

Embodiment 4

Embodiment 4 of the cleaning blade 5 usable in the cleaning device 1 of the above-described image forming apparatus 100 is described.

The cleaning blade 5 according to the present embodiment is different from the cleaning blade according to Embodiment 1 or 3 in that a more preferable range of the Martens hardness $h_B$ of the backup region 7 is specified.

Redundant descriptions about structures similar to Embodiment 1 or 3 and action and effects thereof are omitted. Unless it is necessary to distinguish, the same reference characters are given to the same or similar elements in the descriptions below.

When the Martens hardness $h_B$ of the backup region 7 is lower than 0.5 $N/mm^2$, the contact pressure (line pressure) of the edge 61 contacting the photoconductor 10 can decrease to a degree to allow the substances to pass through the clearance between the photoconductor 10 and the edge 61 (i.e., toner escaping).

When the Martens hardness $h_B$ of the backup region 7 is higher than 2.0 $N/mm^2$, it is possible that a greater amount of load is applied to the edge 61 when the edge 61 overstrides the substances adhering on the photoconductor 10 and the cleaning blade 5 deforms. Receiving the load, the edge 61, on which the photoconductor 10 slides, can wear or be damaged.

In view of the foregoing, in the cleaning blade 5 according to the present embodiment, the Martens hardness $h_B$ of the backup region 7 is in the range of from 0.5 $N/mm^2$ to 2.0 $N/mm^2$ to inhibit the substances (e.g., residual toner and additives) from escaping the edge 61 as well as wear and damage of the edge 61.

Next, a verification experiment performed to ascertain effects of the cleaning blade 5 according to the present embodiment is described.

Measurement of the Martens hardness of the each region was measured in a manner similar to that in Embodiments 1 through 3.

Multiple configurations of the cleaning blade 5 according to the present embodiment and comparative examples, used in the verification experiment, and verification results thereof are specified in Table 4 below.

TABLE 4

| | Blade type | X | $S_A$ [$mm^2$] | $S_B$ [$mm^2$] | $h_A$ | $h_B$ | t [mm] | Cleaning capability |
|---|---|---|---|---|---|---|---|---|
| Configuration 1 | 1 | 0.9 | 4.9 | 17.6 | 1.8 | 0.7 | 0.17 | Excellent |
| Configuration 2 | 2 | 0.9 | 3.0 | 16.3 | 2.0 | 0.7 | 0.24 | Excellent |
| Configuration 3 | 3 | 0.9 | 0.2 | 22.3 | 5.0 | 0.9 | 0.09 | Excellent |
| Configuration 4 | 4 | 0.9 | 0.2 | 22.3 | 5.0 | 0.9 | 0.09 | Excellent |
| Configuration 5 | 1 | 1.3 | 5.8 | 16.8 | 3.0 | 0.7 | 0.20 | Excellent |
| Configuration 6 | 2 | 1.1 | 6.3 | 16.3 | 2.0 | 0.7 | 0.50 | Excellent |
| Configuration 7 | 3 | 1.0 | 0.2 | 22.3 | 5.0 | 1.0 | 0.10 | Good |
| Configuration 8 | 4 | 1.0 | 0.2 | 22.3 | 5.0 | 1.0 | 0.10 | Good |
| Configura- | 1 | 2.3 | 5.8 | 16.8 | 3.0 | 2.0 | 0.20 | Accept- |

TABLE 4-continued

| | Blade type | X | $S_A$ [mm$^2$] | $S_B$ [mm$^2$] | $h_A$ | $h_B$ | t [mm] | Cleaning capability |
|---|---|---|---|---|---|---|---|---|
| tion 9 | | | | | | | | able |
| Configuration 10 | 2 | 2.0 | 6.3 | 16.3 | 2.0 | 2.0 | 0.50 | Acceptable |
| Configuration 11 | 3 | 2.0 | 0.2 | 22.3 | 5.0 | 2.0 | 0.10 | Acceptable |
| Configuration 12 | 4 | 2.0 | 0.2 | 22.3 | 5.0 | 2.0 | 0.10 | Acceptable |
| Comparative example 1 | 1 | 1.6 | 5.8 | 16.8 | 5.0 | 0.4 | 0.20 | Poor |
| Comparative example 2 | 2 | 1.7 | 6.3 | 16.3 | 5.0 | 0.4 | 0.50 | Poor |
| Comparative example 3 | 1 | 2.9 | 5.8 | 16.8 | 5.0 | 2.2 | 0.20 | Poor |
| Comparative example 4 | 2 | 2.9 | 6.3 | 16.3 | 5.0 | 2.1 | 0.50 | Poor |
| Comparative example 5 | 3 | 2.5 | 0.2 | 22.3 | 5.0 | 2.5 | 0.10 | Poor |
| Comparative example 6 | 4 | 2.5 | 0.2 | 22.3 | 5.0 | 2.5 | 0.10 | Poor |

[Evaluation Method]

(Cleaning Capability)

The cleaning capability was evaluated under the following conditions.

As a test machine (an image forming apparatus), Ricoh PC 3503 was used. In the test machine, the cleaning blade 5 of the process cartridge 121 illustrated in FIG. 2 was replaced with each of the cleaning blades according to Configurations 1 through 12 and Comparative examples 1 through 6 specified in Table 4.

The test machine was left unused for 24 hours in the cold environment (10° C.), and then images were successively output on 30,000 sheets. To input a greater amount of toner to the photoconductor 10 (an image bearer), a solid image extending entirely in A4 size was output.

The cleaning capability was evaluated in the following manner and rated in four grades of "Excellent", "Good", "Acceptable", and "Poor".

Excellent: No trace of defective cleaning is observed on the transfer sheet after feeding of 30,000 sheets. There is no practical disadvantage. Defective cleaning does not occur even under a severe condition in which the charging current is increased, which is a harsh condition for cleaning.

Good: After output of 30,000 sheets, the trace of defective cleaning is not observed on the transfer sheets, and practically there are no problems.

Acceptable: No trace of defective cleaning is observed on the transfer sheets after output of 30,000 sheets. Although there is no practical disadvantage, toner escaping the cleaning blade 5 on the photoconductor 10 is observed with eyes.

Poor: After output of 30,000 sheets, the trace of defective cleaning is observed on the transfer sheets, and the outputs images are practically substandard.

[Evaluation Results]

(Configuration 1)

Configuration 1 employs Blade type 1 illustrated in FIG. 3A. The cross-sectional area $S_A$ of the edge region 6 including the edge 61 is 4.9 mm$^2$, and the cross-sectional area $S_B$ of the backup region 7 (does not include the edge 61) is 17.6 mm$^2$. The Martens hardness $h_A$ of the edge region 6 is 1.8 N/mm$^2$, and the Martens hardness $h_B$ of the backup region 7 is 0.7 N/mm$^2$. The converted Martens hardness X calculated according to Formula 1 is 0.9 N/mm$^2$.

The thickness t of the layer-like portion including the edge 61 is 0.17 mm.

The converted Martens hardness X is within the range of from 0.9 N/mm$^2$ to 2.9 N/mm$^2$, and the thickness t is not greater than 0.50 mm. The Martens hardness $h_B$ of the backup region 7 satisfies the range specified in Embodiment 4 (in the range of from 0.5 N/mm$^2$ to 2.0 N/mm$^2$).

Cleaning capability was rated as excellent. That is, defective cleaning did not occur.

(Configurations 2 through 12)

Similar to Configuration 1, the converted Martens hardness X is within the range of from 0.9 N/mm$^2$ to 2.9 N/mm$^2$, and the thickness t of the layer-like portion including the edge 61, defined for each Blade type, is smaller than or equal to 0.50 mm. The Martens hardness $h_A$ of the edge region 6 is greater than or equal to the Martens hardness $h_B$ of the backup region 7, which does not includes the edge 61 ($h_A \geq h_B$). The Martens hardness $h_B$ of the backup region 7 satisfies the range specified in Embodiment 4 (in the range of from 0.5 N/mm$^2$ to 2.0 N/mm$^2$). Cleaning capability was rated as excellent, good, or acceptable. No trace of defective cleaning was observed on the transfer sheet, and defective cleaning did not occur.

Comparative Examples 1 Through 6

Differently from Configurations 1 through 12, the Martens hardness $h_B$ of the backup region 7, which does not include the edge 61, is smaller than 0.5 N/mm$^2$ or greater than 2.0 N/mm$^2$, that is, out of the range of from 0.5 N/mm$^2$ to 2.0 N/mm$^2$.

As described above, when the Martens hardness $h_B$ of the backup region 7 is lower than 0.5 N/mm$^2$, the contact pressure (line pressure) of the edge 61 decrease to the degree to allow the substances to escape the cleaning blade 5. When the Martens hardness $h_B$ of the backup region 7 is higher than 2.0 N/mm$^2$, the edge 61 receives a greater amount of load and is damaged upon deformation of the cleaning blade 5. Therefore, cleaning capability deteriorated and was rated as poor. That is, defective cleaning was obvious on the transfer sheet.

The above verification results confirm that the combination of the features of Embodiments 1 through 3 and the feature that the Martens hardness $h_B$ of the backup region 7 is in the range from 0.5 N/mm$^2$ to 2.0 N/mm$^2$ is advantageous in inhibiting escaping of the substances (passing through the clearance between the photoconductor 10 and the edge 61) as well as wear and chipping of the edge 61.

Embodiment 5

Embodiment 5 of the cleaning blade 5 usable in the cleaning device 1 of the above-described image forming apparatus 100 is described.

The cleaning blade 5 according to the present embodiment is different from that according to any one of Embodiments 1 through 4 in that the cleaning Blade type is Blade type 1 illustrated in FIG. 3A and a more preferable range of the thickness t of the layer-like portion including the edge 61 is specified.

Redundant descriptions about structures similar to Embodiments 1 through 4 and action and effects thereof are omitted. Unless it is necessary to distinguish, the same reference characters are given to the same or similar elements in the descriptions below.

In Blade type 1, when the thickness t of the layer-like portion including the edge 61 is thinner than 0.05 mm, it is possible that the backup region 7 is exposed as the edge 61, on which the photoconductor 10 slides, is abraded. Then, the cleaning capability is degraded. By contrast, when the thickness t is thicker than 0.20 mm, that is, the percentage of the high-hardness region is greater, there is the risk of fatigue of the cleaning blade 5.

In view of the foregoing, in Blade type 1 of the cleaning blade 5 according to the present embodiment, the thickness t of the layer-like edge region 6 is in a range of from 0.05 mm to 0.20 mm to inhibit the backup region 7 from being exposed and inhibit the fatigue of the cleaning blade 5.

Next, a verification experiment performed to ascertain effects of the cleaning blade 5 according to the present embodiment is described.

The Martens hardness of each region was measured in a manner similar to that in Embodiments 1 through 4.

Multiple configurations of the cleaning blade 5 according to the present embodiment and comparative examples, used in the verification experiment, and verification results thereof are specified in Table 5 below.

TABLE 5

| | Blade type | X | $S_A$ [mm$^2$] | $S_B$ [mm$^2$] | $h_A$ | $h_B$ | t [mm] | Cleaning capability |
|---|---|---|---|---|---|---|---|---|
| Configuration 1 | 1 | 1.0 | 1.4 | 21.1 | 3.0 | 0.9 | 0.05 | Excellent |
| Configuration 2 | 1 | 1.0 | 2.9 | 19.6 | 3.0 | 0.7 | 0.10 | Excellent |
| Configuration 3 | 1 | 1.1 | 4.3 | 18.2 | 3.0 | 0.7 | 0.15 | Excellent |
| Configuration 4 | 1 | 1.9 | 5.8 | 16.8 | 3.0 | 1.5 | 0.20 | Good |
| Comparative example 1 | 1 | 0.9 | 0.3 | 22.2 | 5.0 | 0.8 | 0.01 | Poor |
| Comparative example 2 | 1 | 0.9 | 0.3 | 16.0 | 5.0 | 0.8 | 0.01 | Poor |
| Comparative example 3 | 1 | 2.4 | 8.6 | 13.9 | 5.0 | 0.8 | 0.30 | Poor |
| Comparative example 4 | 1 | 2.9 | 11.5 | 11.0 | 5.0 | 0.8 | 0.40 | Poor |

[Evaluation Method]

(Cleaning Capability)

The cleaning capability was evaluated under the following conditions.

As a test machine (an image forming apparatus), Ricoh PC 3503 was used. In the test machine, the cleaning blade 5 of the process cartridge 121 illustrated in FIG. 2 was replaced with each of the cleaning blades according to Configurations 1 through 4 and Comparative examples 1 through 4 listed in Table 5.

The test machine was left unused for 24 hours in the cold environment (10° C.), and then images were successively output on 30,000 sheets. To input a greater amount of toner to the photoconductor 10 (an image bearer), a solid image extending entirely in A4 size was output.

The cleaning capability was evaluated in the following manner and rated in four grades of "Excellent", "Good", "Acceptable", and "Poor".

Excellent: No trace of defective cleaning is observed on the transfer sheet after feeding of 30,000 sheets. There is no practical disadvantage. Defective cleaning does not occur even under a severe condition in which the charging current is increased, which is a harsh condition for cleaning.

Good: After output of 30,000 sheets, the trace of defective cleaning is not observed on the transfer sheets, and practically there are no problems.

Acceptable: No trace of defective cleaning is observed on the transfer sheets after output of 30,000 sheets. Although there is no practical disadvantage, toner escaping the cleaning blade 5 on the photoconductor 10 is observed with eyes.

Poor: After output of 30,000 sheets, the trace of defective cleaning is observed on the transfer sheets, and the outputs images are practically substandard.

[Evaluation Results]

(Configuration 1)

In Blade type 1 illustrated in FIG. 3A, the cross-sectional area $S_A$ of the edge region 6 including the edge 61 is 1.4 mm$^2$, and the cross-sectional area $S_B$ of the backup region 7 (the rest) is 21.1 mm$^2$. The Martens hardness $h_A$ of the edge region 6 is 3.0 N/mm$^2$, and the Martens hardness $h_B$ of the backup region 7 is 0.9 N/mm$^2$. The converted Martens hardness X calculated according to Formula 1 is 1.0 N/mm$^2$.

The thickness t of the layer-like portion including the edge 61 is 0.05 mm.

The converted Martens hardness X is within the range of from 0.9 N/mm$^2$ to 2.9 N/mm$^2$. The thickness t is not greater than 0.50 mm. More particularly, the thickness t satisfies the range according to Embodiment 5 (from 0.05 mm to 0.20 mm).

Cleaning capability was rated as excellent. That is, defective cleaning did not occur.

(Configurations 2 through 4)

Similar to Configuration 1, the converted Martens hardness X according to Formula 1 is within the range of from 0.9 N/mm$^2$ to 2.9 N/mm$^2$. The thickness t satisfies the range according to Embodiment 5 (from 0.05 mm to 0.20 mm).

Cleaning capability was rated as excellent or good. No trace of defective cleaning was observed on the transfer sheet, and defective cleaning did not occur.

Comparative Examples 1 Through 4

Differently from Configurations 1 through 4, the thickness t of the layer-like portion including the edge 61 (of Blade type 1) is smaller than 0.05 mm or greater than 0.20 mm, that is, out of the range of from 0.05 mm to 0.20 mm.

As described above, in Blade type 1, when the thickness t is thinner than 0.05 mm, the backup region 7 is exposed as the edge 61 is abraded by the sliding contact with the photoconductor 10. When the thickness t is thicker than 0.20 mm, that is, the percentage of the high-hardness region is greater, the cleaning blade 5 fatigues. Therefore, cleaning capability deteriorated and was rated as poor. That is, defective cleaning was obvious on the transfer sheet.

The above verification results confirm that the combination of the features of Embodiments 1 through 4 and the feature that the thickness t of the layer-like portion including the edge 61 (in Blade type 1) is in the range of from 0.05 mm to 0.20 mm is advantageous in inhibiting the backup region 7 from being exposed and inhibiting the fatigue of the cleaning blade 5, thereby alleviating the degradation of cleaning capability.

Embodiment 6

Embodiment 6 of the cleaning blade 5 usable in the cleaning device 1 of the above-described image forming apparatus 100 is described.

The cleaning blade 5 according to the present embodiment is different from that according to any one of Embodiments 1 through 4 in that the cleaning Blade type is Blade type 2 illustrated in FIG. 3B and a more preferable range of the thickness t of the layer-like portion including the edge 61 is specified.

Redundant descriptions about structures similar to Embodiments 1 through 4 and action and effects thereof are omitted. Unless it is necessary to distinguish, the same reference characters are given to the same or similar elements in the descriptions below.

In Blade type 2, when the thickness t of the layer-like portion including the edge 61 is thinner than 0.05 mm, it is possible that the backup region 7 is exposed as the edge 61 is abraded by the sliding contact with the photoconductor 10. Then, the cleaning capability is degraded. By contrast, when the thickness t is thicker than 0.50 mm, the percentage of the high-hardness region is greater, and there is the risk of fatigue of the cleaning blade 5.

In view of the foregoing, in the cleaning blade 5 according to the present embodiment, the thickness t of the layer-like portion including the edge 61 is made greater than or equal to 0.05 mm and smaller than or equal to 0.50 mm (in a range of from 0.05 mm to 0.50 mm) to inhibit the backup region 7 from being exposed and inhibit the fatigue of the cleaning blade 5.

Next, a verification experiment performed to ascertain effects of the cleaning blade 5 according to the present embodiment is described.

The Martens hardness of each region was measured in a manner similar to that in Embodiments 1 through 5.

Multiple configurations of the cleaning blade 5 according to the present embodiment and comparative examples, used in the verification experiment, and verification results thereof are specified in Table 6 below.

TABLE 6

| | Blade type | X | $S_A$ [mm$^2$] | $S_B$ [mm$^2$] | $h_A$ | $h_B$ | t [mm] | Cleaning capability |
|---|---|---|---|---|---|---|---|---|
| Configuration 1 | 2 | 0.9 | 0.6 | 16.3 | 2.0 | 0.9 | 0.05 | Excellent |
| Configuration 2 | 2 | 0.8 | 1.3 | 16.3 | 1.5 | 0.7 | 0.10 | Excellent |
| Configuration 3 | 2 | 0.9 | 3.8 | 16.3 | 1.5 | 0.7 | 0.30 | Excellent |
| Configuration 4 | 2 | 1.0 | 5.6 | 16.3 | 2.0 | 0.7 | 0.45 | Excellent |
| Configuration 5 | 2 | 1.1 | 6.3 | 16.3 | 2.0 | 0.7 | 0.50 | Excellent |
| Configuration 6 | 2 | 1.6 | 5.6 | 16.3 | 2.0 | 1.5 | 0.45 | Good |
| Configuration 7 | 2 | 1.6 | 6.3 | 16.3 | 2.0 | 1.5 | 0.50 | Good |
| Comparative example 1 | 2 | 2.0 | 0.1 | 22.5 | 5.0 | 2.0 | 0.01 | Poor |
| Comparative example 2 | 2 | 2.0 | 0.1 | 16.3 | 5.0 | 2.0 | 0.01 | Poor |
| Comparative example 3 | 2 | 2.7 | 11.3 | 12.5 | 5.0 | 0.7 | 0.90 | Poor |
| Comparative example 4 | 2 | 2.9 | 12.5 | 12.5 | 5.0 | 0.8 | 1.00 | Poor |

[Evaluation Method]

(Cleaning Capability)

The cleaning capability was evaluated under the following conditions.

As a test machine (an image forming apparatus), Ricoh PC 3503 was used. In the test machine, the cleaning blade 5 of the process cartridge 121 illustrated in FIG. 2 was replaced with each of the cleaning blades according to Configurations 1 through 7 and Comparative examples 1 through 4 listed in Table 6.

The test machine was left unused for 24 hours in the cold environment (10° C.), and then images were successively output on 30,000 sheets. To input a greater amount of toner to the photoconductor 10 (an image bearer), a solid image extending entirely in A4 size was output.

The cleaning capability was evaluated in the following manner and rated in four grades of "Excellent", "Good", "Acceptable", and "Poor".

Excellent: No trace of defective cleaning is observed on the transfer sheet after feeding of 30,000 sheets. There is no practical disadvantage. Defective cleaning does not occur even under a severe condition in which the charging current is increased, which is a harsh condition for cleaning.

Good: After output of 30,000 sheets, the trace of defective cleaning is not observed on the transfer sheets, and practically there are no problems.

Acceptable: No trace of defective cleaning is observed on the transfer sheets after output of 30,000 sheets. Although there is no practical disadvantage, toner escaping the cleaning blade 5 on the photoconductor 10 is observed with eyes.

Poor: After output of 30,000 sheets, the trace of defective cleaning is observed on the transfer sheets, and the outputs images are practically substandard.

[Evaluation Results]

(Configuration 1)

In Blade type 2 illustrated in FIG. 3B, the cross-sectional area $S_A$ of the edge region 6 including the edge 61 is 0.6 mm$^2$, and the cross-sectional area $S_B$ of the backup region 7 (without the edge 61) is 16.3 mm$^2$. The Martens hardness $h_A$ of the edge region 6 is 2.0 N/mm$^2$, and the Martens hardness $h_B$ of the backup region 7 is 0.9 N/mm$^2$. The converted Martens hardness X calculated according to Formula 1 is 0.9 N/mm$^2$.

The thickness t of the layer-like portion including the edge 61 is 0.05 mm.

The converted Martens hardness X is within the range of from 0.9 N/mm$^2$ to 2.9 N/mm$^2$, and the thickness t is in the range from 0.05 mm to 0.50 mm.

Cleaning capability was rated as excellent. That is, defective cleaning did not occur.

(Configurations 2 through 7)

Similar to Configuration 1, the converted Martens hardness X is within the range of from 0.9 N/mm$^2$ to 2.9 N/mm$^2$ in the cleaning blade 5 of Blade type 2, and the thickness t of the layer-like portion including the edge 61 is in the range from 0.05 mm to 0.50 mm.

Cleaning capability was rated as excellent or good. No trace of defective cleaning was observed on the transfer sheet, and defective cleaning did not occur.

Comparative Examples 1 Through 4

Differently from Configurations 1 through 4, the thickness t of the layer-like portion including the edge 61 (in Blade type 2) is smaller than 0.05 mm or greater than 0.50 mm, that is, out of the range of from 0.05 mm to 0.50 mm.

As described above, in Blade type 2, when the thickness t is thinner than 0.05 mm, the backup region 7 is exposed as the edge 61 is abraded by the sliding contact with the photoconductor 10. Further, when the thickness t of the layer-like portion including the edge 61 is thicker than 0.50 mm, the percentage of the high-hardness region increases, thus inducing the risk of the fatigue of the cleaning blade 5. Therefore, cleaning capability deteriorated and was rated as poor. That is, defective cleaning was obvious on the transfer sheet.

The above verification results confirm that the combination of the features of Embodiments 1 through 4 and the feature that the thickness t of the layer-like portion including the edge 61 (in Blade type 2) is in the range of from 0.05 mm to 0.50 mm is advantageous in inhibiting the backup region 7 from being exposed and inhibiting the fatigue of the cleaning blade 5, thereby alleviating the degradation of cleaning capability.

Embodiment 7

Embodiment 7 of the cleaning blade 5 usable in the cleaning device 1 of the above-described image forming apparatus 100 is described.

The cleaning blade 5 according to the present embodiment is different from that according to any one of Embodiments 1 through 4 in that the cleaning Blade type is Blade type 3 illustrated in FIG. 3C and a more preferable range of the thickness t of the layer-like portion including the edge 61 is specified.

Redundant descriptions about structures similar to Embodiments 1 through 4 and action and effects thereof are omitted. Unless it is necessary to distinguish, the same reference characters are given to the same or similar elements in the descriptions below.

In Blade type 3, when the thickness t of the layer-like portion including the edge 61 is thinner than 0.05 mm, it is possible that the backup region 7 is exposed as the edge 61 is abraded by the sliding contact with the photoconductor 10. Then, the cleaning capability is degraded. By contrast, when the thickness t is thicker than 0.20 mm, that is, the percentage of the high-hardness region is greater, there is the risk of fatigue of the cleaning blade 5. In view of the foregoing, in Blade type 3 of the cleaning blade 5 according to the present embodiment, the thickness t of the layer-like edge region 6 is in a range of from 0.05 mm to 0.20 mm to inhibit the backup region 7 from being exposed and inhibit the fatigue of the cleaning blade 5.

Next, a verification experiment performed to ascertain effects of the cleaning blade 5 according to the present embodiment is described.

The Martens hardness of each region was measured in a manner similar to that in Embodiments 1 through 6.

Multiple configurations of the cleaning blade 5 according to the present embodiment and comparative examples, used in the verification experiment, and verification results thereof are specified in Table 7 below.

TABLE 7

| | Blade type | X | $S_A$ [mm$^2$] | $S_B$ [mm$^2$] | $h_A$ | $h_B$ | t [mm] | Cleaning capability |
|---|---|---|---|---|---|---|---|---|
| Configuration 1 | 3 | 0.9 | 0.1 | 22.4 | 5.0 | 0.9 | 0.05 | Excellent |
| Configuration 2 | 3 | 0.7 | 0.2 | 22.3 | 5.0 | 0.7 | 0.10 | Excellent |
| Configuration 3 | 3 | 1.5 | 0.3 | 22.2 | 5.0 | 1.5 | 0.15 | Excellent |
| Configuration 4 | 3 | 1.6 | 0.4 | 22.1 | 5.0 | 1.5 | 0.20 | Good |
| Comparative example 1 | 3 | 0.9 | 0.0 | 22.5 | 5.0 | 0.9 | 0.01 | Poor |
| Comparative example 2 | 3 | 0.9 | 0.0 | 16.2 | 5.0 | 0.9 | 0.01 | Poor |
| Comparative example 3 | 3 | 0.8 | 0.5 | 22.0 | 5.0 | 0.7 | 0.30 | Poor |
| Comparative example 4 | 3 | 0.8 | 0.7 | 21.8 | 5.0 | 0.7 | 0.40 | Poor |

[Evaluation Method]

(Cleaning Capability)

The cleaning capability was evaluated under the following conditions.

As a test machine (an image forming apparatus), Ricoh PC 3503 was used. In the test machine, the cleaning blade 5 of the process cartridge 121 illustrated in FIG. 2 was replaced with each of the cleaning blades according to Configurations 1 through 4 and Comparative examples 1 through 4 listed in Table 7.

The test machine was left unused for 24 hours in the cold environment (10° C.), and then images were successively output on 30,000 sheets. To input a greater amount of toner to the photoconductor 10 (an image bearer), a solid image extending entirely in A4 size was output.

The cleaning capability was evaluated in the following manner and rated in four grades of "Excellent", "Good", "Acceptable", and "Poor".

Excellent: No trace of defective cleaning is observed on the transfer sheet after feeding of 30,000 sheets. There is no practical disadvantage. Defective cleaning does not occur even under a severe condition in which the charging current is increased, which is a harsh condition for cleaning.

Good: After output of 30,000 sheets, the trace of defective cleaning is not observed on the transfer sheets, and practically there are no problems.

Acceptable: No trace of defective cleaning is observed on the transfer sheets after output of 30,000 sheets. Although there is no practical disadvantage, toner escaping the cleaning blade 5 on the photoconductor 10 is observed with eyes.

Poor: After output of 30,000 sheets, the trace of defective cleaning is observed on the transfer sheets, and the outputs images are practically substandard.

[Evaluation Results]

(Configuration 1)

In the cleaning blade 5 of Blade type 3 illustrated in FIG. 3C, the cross-sectional area $S_A$ of the edge region 6 including the edge 61 is 0.1 mm$^2$, and the cross-sectional area $S_B$ of the backup region 7 without the edge 61 is 22.4 mm$^2$. The Martens hardness $h_A$ of the edge region 6 is 5.0 N/mm$^2$, and the Martens hardness $h_B$ of the backup region 7 is 0.9 N/mm$^2$. The converted Martens hardness X calculated according to Formula 1 is 0.9 N/mm$^2$.

The thickness t of the layer-like portion including the edge 61 is 0.05 mm.

The converted Martens hardness X is within the range of from 0.9 N/mm$^2$ to 2.9 N/mm$^2$, and the thickness t is not greater than 0.50 mm. The thickness t satisfies the range according to Embodiment 5 (from 0.05 mm to 0.20 mm).

Cleaning capability was rated as excellent. That is, defective cleaning did not occur.

(Configurations 2 Through 4)

Similar to Configuration 1, the converted Martens hardness X is within the range of from 0.9 N/mm$^2$ to 2.9 N/mm$^2$ in the cleaning blade 5 of Blade type 3, and the thickness t of the layer-like portion including the edge 61 is in the range from 0.05 mm to 0.20 mm.

Cleaning capability was rated as excellent or good. No trace of defective cleaning was observed on the transfer sheet, and defective cleaning did not occur.

Comparative Examples 1 Through 4

Differently from Configurations 1 through 4, the thickness t of the layer-like portion including the edge 61 (in Blade type 3) is smaller than 0.05 mm or greater than 0.20 mm, that is, out of the range of from 0.05 mm to 0.20 mm.

As described above, in Blade type 3, when the thickness t is thinner than 0.05 mm, the backup region 7 is exposed as the edge 61 is abraded by the sliding contact with the photoconductor 10. Further, when the thickness t of the layer-like portion including the edge 61 is thicker than 0.20 mm, the percentage of the high-hardness region increases, thus inducing the risk of the fatigue of the cleaning blade 5. Therefore, cleaning capability deteriorated and was rated as poor. That is, defective cleaning was obvious on the transfer sheet.

The above verification results confirm that the combination of the features of Embodiments 1 through 4 and the feature that the thickness t of the layer-like portion including the edge 61 (in Blade type 3) is in the range of from 0.05 mm to 0.20 mm is advantageous in inhibiting the backup region 7 from being exposed and inhibiting the fatigue of the cleaning blade 5, thereby alleviating the degradation of cleaning capability.

Embodiment 8

Embodiment 8 of the cleaning blade 5 usable in the cleaning device 1 of the above-described image forming apparatus 100 is described.

The cleaning blade 5 according to the present embodiment is different from that according to any one of Embodiments 1 through 4 in that the cleaning Blade type is Blade type 4 illustrated in FIG. 3D and a more preferable range of the thickness t of the layer-like portion including the edge 61 is specified.

Redundant descriptions about structures similar to Embodiments 1 through 4 and action and effects thereof are omitted. Unless it is necessary to distinguish, the same reference characters are given to the same or similar elements in the descriptions below.

In Blade type 4, when the thickness t of the layer-like portion including the edge 61 is thinner than 0.05 mm, it is possible that the backup region 7 is exposed as the edge 61 is abraded by the sliding contact with the photoconductor 10. Then, the cleaning capability is degraded. By contrast, when the thickness t is thicker than 0.50 mm, the percentage of the high-hardness region is greater, and there is the risk of fatigue of the cleaning blade 5.

In view of the foregoing, in the cleaning blade 5 of Blade type 4, the thickness t of the layer-like portion including the edge 61 is greater than or equal to 0.05 mm and smaller than or equal to 0.50 mm (in a range of from 0.05 mm to 0.50 mm) to inhibit the backup region 7 from being exposed and inhibit the fatigue of the cleaning blade 5.

Next, a verification experiment performed to ascertain effects of the cleaning blade 5 according to the present embodiment is described.

The Martens hardness of each region was measured in a manner similar to that in Embodiments 1 through 7.

Multiple configurations of the cleaning blade 5 according to the present embodiment and comparative examples, used in the verification experiment, and verification results thereof are specified in Table 8 below.

TABLE 8

| | Blade type | X | $S_A$ [mm$^2$] | $S_B$ [mm$^2$] | $h_A$ | $h_B$ | t [mm] | Cleaning capability |
|---|---|---|---|---|---|---|---|---|
| Configuration 1 | 4 | 0.9 | 0.1 | 22.4 | 5.0 | 0.9 | 0.05 | Excellent |
| Configuration 2 | 4 | 0.9 | 0.2 | 22.3 | 5.0 | 0.9 | 0.10 | Excellent |
| Configuration 3 | 4 | 1.4 | 1.0 | 21.5 | 5.0 | 1.2 | 0.50 | Good |
| Comparative example 1 | 4 | 0.9 | 0.0 | 22.5 | 5.0 | 0.9 | 0.01 | Poor |
| Comparative example 2 | 4 | 0.9 | 0.0 | 16.2 | 5.0 | 0.9 | 0.01 | Poor |
| Comparative example 3 | 4 | 2.3 | 2.0 | 20.5 | 5.0 | 2.0 | 1.00 | Poor |
| Comparative example 4 | 4 | 1.0 | 3.0 | 19.5 | 5.0 | 0.4 | 1.50 | Poor |
| Comparative example 5 | 4 | 1.2 | 4.0 | 18.5 | 5.0 | 0.4 | 2.00 | Poor |

[Evaluation Method]

(Cleaning Capability)

The cleaning capability was evaluated under the following conditions.

As a test machine (an image forming apparatus), Ricoh PC 3503 was used. In the test machine, the cleaning blade 5 of the process cartridge 121 illustrated in FIG. 2 was replaced with each of the cleaning blades according to Configurations 1 through 3 and Comparative examples 1 through 5 specified in Table 8.

The test machine was left unused for 24 hours in the cold environment (10° C.), and then images were successively output on 30,000 sheets. To input a greater amount of toner to the photoconductor 10 (an image bearer), a solid image extending entirely in A4 size was output.

The cleaning capability was evaluated in the following manner and rated in four grades of "Excellent", "Good", "Acceptable", and "Poor".

Excellent: No trace of defective cleaning is observed on the transfer sheet after feeding of 30,000 sheets. There is no practical disadvantage. Defective cleaning does not occur even under a severe condition in which the charging current is increased, which is a harsh condition for cleaning.

Good: After output of 30,000 sheets, the trace of defective cleaning is not observed on the transfer sheets, and practically there are no problems.

Acceptable: No trace of defective cleaning is observed on the transfer sheets after output of 30,000 sheets. Although there is no practical disadvantage, toner escaping the cleaning blade 5 on the photoconductor 10 is observed with eyes.

Poor: After output of 30,000 sheets, the trace of defective cleaning is observed on the transfer sheets, and the outputs images are practically substandard.

[Evaluation Results]

(Configuration 1)

In the cleaning blade 5 of Blade type 4 illustrated in FIG. 3D, the cross-sectional area $S_A$ of the edge region 6 including the edge 61 is 0.1 mm$^2$, and the cross-sectional area $S_B$ of the backup region 7 without the edge 61 is 22.4 mm$^2$. The Martens hardness $h_A$ of the edge region 6 is 5.0 N/mm$^2$, and the Martens hardness $h_B$ of the backup region 7 is 0.9 N/mm$^2$. The converted Martens hardness X calculated according to Formula 1 is 0.9 N/mm$^2$.

The thickness t of the layer-like portion including the edge 61 is 0.05 mm.

The converted Martens hardness X is within the range of from 0.9 N/mm$^2$ to 2.9 N/mm$^2$, and the thickness t is in the range from 0.05 mm to 0.50 mm.

Cleaning capability was rated as excellent. That is, defective cleaning did not occur.

(Configurations 2 and 3)

Similar to Configuration 1, the converted Martens hardness X is within the range of from 0.9 N/mm$^2$ to 2.9 N/mm$^2$ in the cleaning blade 5 of Blade type 4, and the thickness t of the layer-like portion including the edge 61 is in the range from 0.05 mm to 0.50 mm.

Cleaning capability was rated as excellent or good. No trace of defective cleaning was observed on the transfer sheet, and defective cleaning did not occur.

Comparative Examples 1 Through 5

Differently from Configurations 1 through 3, the thickness t of the layer-like portion including the edge 61 (in Blade type 4) is smaller than 0.05 mm or greater than 0.50 mm, that is, out of the range of from 0.05 mm to 0.50 mm.

As described above, in Blade type 4, when the thickness t is thinner than 0.05 mm, the backup region 7 is exposed as the edge 61 is abraded by the sliding contact with the photoconductor 10. Further, when the thickness t of the layer-like portion including the edge 61 is thicker than 0.50 mm, the percentage of the high-hardness region increases, thus inducing the risk of the fatigue of the cleaning blade 5. Therefore, cleaning capability deteriorated and was rated as poor. That is, defective cleaning was obvious on the transfer sheet.

The above verification results confirm that the combination of the features of Embodiments 1 through 4 and the feature that the thickness t of the layer-like portion including the edge 61 (in Blade type 4) is in the range of from 0.05 mm to 0.50 mm is advantageous in inhibiting the backup region 7 from being exposed and inhibiting the fatigue of the cleaning blade 5, thereby alleviating the degradation of cleaning capability.

Embodiment 9

Figure 5:
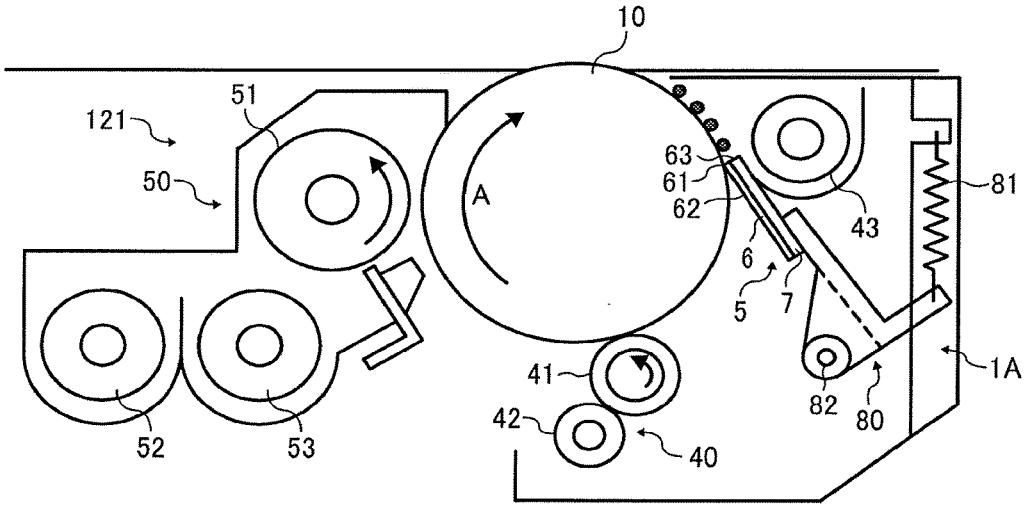
FIG. 5 is a schematic diagram illustrating a configuration of a process cartridge according to Embodiment 9.

Referring to FIG. 5, descriptions are given below of a cleaning device 1A according to Embodiment 9 (different from the cleaning device 1 illustrated in FIG. 2) and the cleaning blade 5 usable in the cleaning device 1A.

FIG. 5 is a schematic view of the process cartridge 121 including the cleaning device 1A according to Embodiment 9. It is to be noted that, in FIG. 5, the cleaning blade 5 of Blade type 2 illustrated in FIG. 3B is illustrated.

In Embodiments 1 through 8, the blade holder 3 supporting the cleaning blade 5 is secured to the cleaning device 1. By contrast, the cleaning device 1A according to Embodiment 9 includes a rotatable blade holder 80 to support the cleaning blade 5 and a spring 81 to press the blade holder 80 to the photoconductor 10. In other words, the cleaning device 1A according to Embodiment 9 employs spring pressurizing using the force of the spring 81 (constant contact-pressure type) to press the cleaning blade 5 to the photoconductor 10.

Redundant descriptions about structures similar to Embodiments 1 through 8 and action and effects thereof are omitted Unless it is necessary to distinguish, the same reference characters are given to the same or similar elements in the descriptions below.

In the above-described cleaning device 1 in which the cleaning blades 5 according to Embodiments 1 through 8 are usable, as illustrated in FIG. 2, the cleaning blade 5 is secured (via the blade holder 3 to the cleaning device 1) in a state in which the edge 61 of the cleaning blade 5 is pressed toward the photoconductor 10 (hereinafter "pressurized-state attachment"). In the pressurized-state attachment in which the cleaning blade 5 being in the pressed state is secured, the line pressure of the edge 61 abutting against the photoconductor 10 significantly decreases when the cleaning blade 5 fatigues, even though the degree of fatigue is small. Then, cleaning tends to be defective. That is, the substances, such as residual toner, pass between the photoconductor 10 and the edge 61 of the cleaning blade 5.

By contrast, the cleaning device 1A according to Embodiment 9 uses the force of the spring 81 (spring pressurizing) to press the edge 61 of the cleaning blade 5 to the photoconductor 10, as illustrated in FIG. 5. Such spring pressurizing inhibits decreases in the line pressure of the edge 61 abutting against the photoconductor 10 even if the fatigue of the cleaning blade 5 occurs. That is, the line pressure can be kept almost constant, and defective cleaning is inhibited.

Specifically, the spring pressurizing of the cleaning blade 5 is attained by the following structure. As illustrated in FIG. 5, the blade holder 80 has a rotation support 82, serving as a rotation axis. Due to the tension of the spring 81 (e.g., a tension spring), the blade holder 80 rotates or pivots around the rotation support 82 to press the edge 61 of the cleaning blade 5 to the photoconductor 10. It is to be noted that, in the cleaning device 1A according to the present embodiment, the pressing force (line pressure) of the edge 61 is set at 20.0 g/cm.

The cleaning blade 5 according to Embodiment 9 is a two-region blade similar to the cleaning blades 5 according to Embodiments 1 through 8, to inhibit the fatigue of the cleaning blade 5.

With the above-described feature of the cleaning device 1A, decreases in the line pressure are suppressed, thereby inhibiting defective cleaning.

Next, a verification experiment performed to ascertain effects of the cleaning blade 5 according to the present embodiment is described.

The Martens hardness of each region was measured in a manner similar to that in Embodiments 1 through 8.

Multiple configurations of the cleaning blade 5 according to the present embodiment and comparative examples, used in the verification experiment, and verification results thereof are specified in Table 9 below.

TABLE 9

| | Blade type | X | $S_A$ [mm ] | $S_B$ [mm] | $h_A$ | $h_B$ | t [mm] | Pressing type | Cleaning capability |
|---|---|---|---|---|---|---|---|---|---|
| Configuration 1 | 1 | 2.9 | 5.8 | 16.8 | 5.0 | 2.2 | 0.20 | Spring | Good |
| Configuration 2 | 2 | 2.9 | 5.6 | 16.3 | 5.0 | 2.2 | 0.45 | Spring | Good |
| Configuration 3 | 2 | 2.9 | 6.3 | 16.3 | 5.0 | 2.1 | 0.50 | Spring | Good |
| Configuration 4 | 3 | 2.8 | 0.2 | 22.3 | 5.0 | 2.8 | 0.10 | Spring | Good |
| Configura- | 4 | 2.8 | 0.2 | 22.3 | 5.0 | 2.8 | 0.10 | Spring | Good |

TABLE 9-continued

| | Blade type | X | $S_A$ [mm ] | $S_B$ [mm] | $h_A$ | $h_B$ | t [mm] | Pressing type | Cleaning capability |
|---|---|---|---|---|---|---|---|---|---|
| tion 5 | | | | | | | | | |
| Comparative example 1 | 1 | 2.9 | 5.8 | 16.8 | 5.0 | 2.2 | 0.20 | Pressurized-state attachment | Poor |
| Comparative example 2 | 2 | 2.9 | 5.6 | 16.3 | 5.0 | 2.2 | 0.45 | Pressurized-state attachment | Poor |
| Comparative example 3 | 2 | 2.9 | 6.3 | 16.3 | 5.0 | 2.1 | 0.50 | Pressurized-state attachment | Poor |
| Comparative example 4 | 3 | 2.8 | 0.2 | 22.3 | 5.0 | 2.8 | 0.10 | Pressurized-state attachment | Poor |
| Comparative example 5 | 4 | 2.8 | 0.2 | 22.3 | 5.0 | 2.8 | 0.10 | Pressurized-state attachment | Poor |

[Evaluation Method]

(Cleaning Capability)

The cleaning capability was evaluated under the following conditions.

As a test machine (an image forming apparatus), Ricoh PC 3503 was used. In the test machine, the cleaning blade 5 of the process cartridge 121 illustrated in FIG. 5 was replaced with those according to Configurations 1 through 5 and Comparative examples 1 through 5 specified in Table 9.

The test machine was left unused for 24 hours in the cold environment (10° C.), and then images were successively output on 30,000 sheets. To input a greater amount of toner to the photoconductor 10 (an image bearer), a solid image extending entirely in A4 size was output.

The cleaning capability was evaluated in the following manner and rated in four grades of "Excellent", "Good", "Acceptable", and "Poor".

Excellent: No trace of defective cleaning is observed on the transfer sheet after feeding of 30,000 sheets. There is no practical disadvantage. Defective cleaning does not occur even under a severe condition in which the charging current is increased, which is a harsh condition for cleaning.

Good: After output of 30,000 sheets, the trace of defective cleaning is not observed on the transfer sheets, and practically there are no problems.

Acceptable: No trace of defective cleaning is observed on the transfer sheets after output of 30,000 sheets. Although there is no practical disadvantage, toner escaping the cleaning blade 5 on the photoconductor 10 is observed with eyes.

Poor: After output of 30,000 sheets, the trace of defective cleaning is observed on the transfer sheets, and the outputs images are practically substandard.

[Evaluation Results]

(Configuration 1)

Configuration 1 employs Blade type 1 illustrated in FIG. 3A. The cross-sectional area $S_A$ of the edge region 6 including the edge 61 is 5.8 mm$^2$, and the cross-sectional area $S_B$ of the backup region 7, which does not include the edge 61, is 16.8 mm$^2$. The Martens hardness $h_A$ of the edge region 6 is 5.0 N/mm$^2$, and the Martens hardness $h_B$ of the backup region 7 is 2.2 N/mm$^2$. The converted Martens hardness X calculated according to Formula 1 is 2.9 N/mm$^2$.

The thickness t of the layer-like portion including the edge 61 is 0.20 mm.

The converted Martens hardness X is within the range of from 0.9 N/mm$^2$ to 2.9 N/mm$^2$, and the thickness t is not greater than 0.50 mm. The spring pressurizing (illustrated in FIG. 5, represented by "Spring" in Table 9) is used to press the edge 61 of the cleaning blade 5 to the photoconductor 10.

Cleaning capability was rated as good. That is, no trace of defective cleaning was observed on the transfer sheet, and defective cleaning did not occur.

(Configurations 2 through 5)

Similar to Configuration 1, the converted Martens hardness X is within the range of from 0.9 N/mm$^2$ to 2.9 N/mm$^2$, and the thickness t of the layer-like portion including the edge 61, defined for each of Blade types 1 through 4, is smaller than or equal to 0.50 mm. The spring pressurizing illustrated in FIG. 5 is used to press the edge 61 of the cleaning blade 5 to the photoconductor 10.

Cleaning capability was rated as good. That is, no trace of defective cleaning was observed on the transfer sheet, and defective cleaning did not occur.

Comparative Examples 1 Through 5

Differently from Configurations 1 through 5, the pressurized-state attachment, in which the cleaning blade 5 being pressed to the photoconductor 10 is secured, is employed.

As described above, in the pressurized-state attachment in which the cleaning blade 5 being pressed is secured, the line pressure of the edge 61 abutting against the photoconductor 10 significantly decreases when the cleaning blade 5 fatigues, even though the degree of fatigue is small. Then, defective cleaning tends to occur. That is, the substances, such as residual toner, pass between the photoconductor 10 and the edge 61 of the cleaning blade 5. Therefore, cleaning capability deteriorated and was rated as poor. That is, defective cleaning was obvious on the transfer sheet.

The above verification results confirm that, in addition to the combination of the features of Embodiments 1 through 4 and one of Embodiments 5 through 8, use of spring pressurizing with the spring 81 (constant contact-pressure type) to press the edge 61 of the cleaning blade 5 to the photoconductor 10 is advantageous in suppressing decreases in the line pressure to inhibit defective cleaning.

Described above are the cleaning device 1 according to Embodiment 1, the cleaning device 1A according to Embodiment 9, and the cleaning blades 5 according to Embodiments 1 through 8 usable in the cleaning devices 1 and 1A.

The image forming apparatus 100 can incorporate the cleaning blades 5 according to one of Embodiments 1 through 8, the cleaning device 1, or the cleaning device 1A to exhibit the effect similar to the effect of the cleaning blade 5 or the cleaning device 1 or 1A incorporated therein.

For example, the image forming apparatus 100 can clean the photoconductor 10 preferably after the image transfer to inhibit the occurrence of image failure caused by defective cleaning.

Next, other features of the image forming apparatus 100 are described in detail below.

The charging device 40 to uniformly charge the surface of the photoconductor 10 is described.

When the charging device 40 to charge the photoconductor 10 includes a contact-type charger (e.g., a charging roller) to apply superimposed voltage including direct current (DC) voltage and alternating current (AC) voltage, a charging current is greater and the charging potential is stabilized. Then, image quality is enhanced and the operational life of the apparatus is expanded.

However, when the AC voltage is applied to the contact-type charging roller 41, the surface of the photoconductor 10 is roughened, which is inconvenient for cleaning the photoconductor 10. Specifically, when the surface of the photoconductor 10 is rough, the capability of the edge 61 of the cleaning blade 5 to follow the photoconductor 10 decreases. Alternatively, the cleaning blade 5 fatigues or is chipped. Then, the amount of the substances, such as the residual toner, passing between the photoconductor 10 and the edge 61 increases.

By contrast, use of the above-described two-region blade 5 can inhibit the degradation of capability of the cleaning blade 5 to follow the photoconductor 10 and fatigue and chipping of the cleaning blade 5. Owing to the inhibition (in other words, use of the cleaning blade 5 according to one of Embodiments 1 through 9), even in the configuration in which the contact-type charging roller 41 applies the AC voltage to the photoconductor 10, the cleaning capability of the cleaning blade 5 is less degraded by the roughened surface of the photoconductor 10.

If the amount of the substances passing between the photoconductor 10 and the edge 61 increases due to the application of AC current to the charger (the charging roller 41) of the charging device 40, the charging roller 41 is soiled with the residual toner or the additives, resulting in image failure.

By contrast, use of the above-described two-region blade 5 can reduce the amount of the substances passing between the photoconductor 10 and the edge 61. Owing to the reduction (in other words, owing to the use of the cleaning blade 5 according to one of Embodiments 1 through 9), even in the image forming apparatus 100 employing the charging device 40 to apply the AC voltage to the photoconductor 10, the occurrence of abnormal caused by the soiled charging roller 41 is inhibited.

Next, descriptions are given below of the photoconductor 10 serving as the image bearer in the image forming apparatus 100.

FIGS. 6A through 6D illustrate layer structures applicable to the photoconductor 10 of the image forming apparatus 100. In the layer structure illustrated in FIG. 6A, the photoconductor 10 includes a conductive support 91 and a photosensitive layer 92 overlying the conductive support 91, and inorganic particles are present at or adjacent to the surface of the photosensitive layer 92. The layer structure illustrated in FIG. 6B includes, from the bottom, the conductive support 91, the photosensitive layer 92, and the surface layer 93 including inorganic particles. The layer structure illustrated in FIG. 6C includes, from the bottom, the conductive support 91, the photosensitive layer 92, and the surface layer 93 including inorganic particles. Further, the photosensitive layer 92 includes a charge generation layer 921 and a charge transport layer 922. The layer structure illustrated in FIG. 6D includes, from the bottom, the conductive support 91; a under layer 94; the photosensitive layer 92 including the charge generation layer 921 and the charge transport layer 922; and the surface layer 93 including inorganic particles.

The photoconductor 10 according to the present embodiment includes at least the photosensitive layer 92 above the conductive support 91 and contains inorganic particles at or adjacent to the surface of the photoconductor 10. Another layer or other layers (e.g., the surface layer 93) can be combined in such as layer structure.

Including inorganic particles at the surface (or in the surface layer) of the photoconductor 10 is advantageous in inhibiting wear (in particular, uneven wear or partial wear) of the photoconductor 10, thereby improving image quality, performance stability of the apparatus, and operational life.

The inorganic particles at the surface of the photoconductor 10 create micro surface unevenness, which can degrade the cleaning capability of the cleaning blade 5 as described below.

The uneven surface of the photoconductor 10 can cause the edge 61 of the cleaning blade 5 to vibrate. If the edge 61 of the cleaning blade 5 vibrates significantly, the capability of the edge 61 of the cleaning blade 5 to follow the photoconductor 10 decreases, or the cleaning blade 5 fatigues or is chipped. Then, the amount of the substances, such as the residual toner, passing between the photoconductor 10 and the edge 61 increases.

By contrast, use of the above-described two-region blade 5 can inhibit the degradation of capability of the cleaning blade 5 to follow the photoconductor 10 and fatigue and chipping of the cleaning blade 5. Accordingly, even if the inorganic particles are included at the surface or in the surface layer of the photoconductor 10, the cleaning capability of the cleaning blade 5 is less degraded by the roughened surface of the photoconductor 10.

As described above, in the layer structure illustrated in FIG. 6A, the photosensitive layer 92 serves as the surface layer and includes inorganic particles. In the layer structures illustrated in FIGS. 6B, 6C, and 6D, the surface layer 93 includes inorganic particles. When the photosensitive layer 92 includes the charge generation layer 921 and the charge transport layer 922 serves as the surface layer, the charge transport layer 922 includes inorganic particles.

Examples of inorganic particles added to the layer structure of the photoconductor 10 include metal powder such as copper, tin, aluminum, and indium; metal oxide such as silicon oxide, silica, tin oxide, zinc oxide, titanium oxide, indium oxide, antimony oxide, bismuth oxide, tin oxide in which antimony is doped, and indium oxide in which tin is doped; and inorganic material such as potassium titanate. Metal oxide is particularly preferable, and further silicon oxide, aluminum oxide, and titanium oxide are effective.

The inorganic particle preferably has an average primary particle diameter from 0.01 to 0.5 μm considering the characteristics of the surface layer 93 such as light transmission degree and abrasion resistance.

The abrasion resistance and the degree of dispersion decrease when the average primary particle diameter is smaller than or equal to 0.01 μm. Additionally, when the average primary particle diameter is greater than or equal to 0.5 μm, inorganic particles in the dispersion liquid can sink more easily, and toner filming can occur.

As the amount of inorganic particles added increases, abrasion resistance increases, which is desirable. An extremely large amount of inorganic particles, however, causes side effects such as increases in residual potentials and decreases in the light transmission rate of writing light into a protective layer.

Accordingly, the amount of addition to the total solid amount is smaller than or equal to about 30% by weight, and more preferably smaller than or equal to 20% by weight. The lower limit is generally 3% by weight.

The above-described inorganic particles can be treated with at least one surface treatment agent, which is preferable for facilitating the dispersion of inorganic particles.

Decreases in dispersion of inorganic particles can cause, in addition to the rise of residual potentials, degradation of transparency of coating, defective coating, and further degradation of abrasion resistivity. Accordingly, the decrease in dispersion of inorganic particles can hinder the extension of operational life or image quality improvement.

Figure 6A:
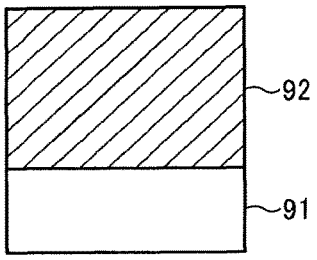
FIGS. 6A through 6D illustrate layer structures of the photoconductor according to an embodiment.
Figure 6B:
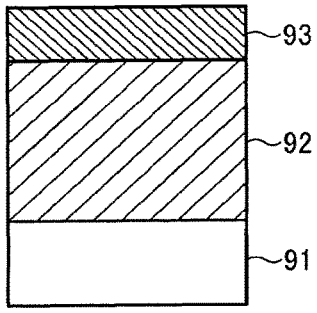
Figure 6C:
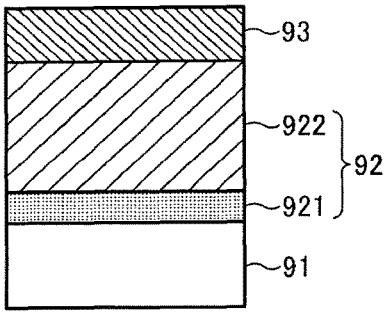
Figure 6D:
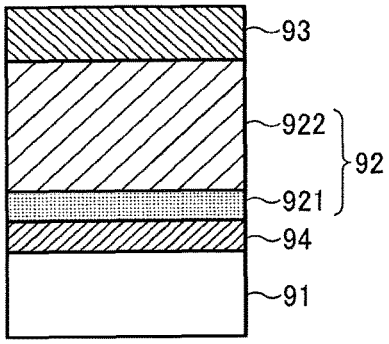

Next, descriptions are given below of the photoconductor 10 having one of the layer structures illustrated in FIGS. 6B through 6D, in which the surface layer 93 is disposed above the photosensitive layer 92 and includes inorganic particles.

The surface layer 93 includes at least inorganic particles and binder resin.

The inorganic particles can be similar to those included in the photosensitive layer 92 in the layer structure in which the photosensitive layer 92 serves as the surface layer.

The primary particle diameter of inorganic particles can be similar to that in the layer structure in which the photosensitive layer 92 serves as the surface layer.

The abrasion resistance and the degree of dispersion decrease when the average primary particle diameter is smaller than or equal to 0.01 μm. When the average primary particle diameter is greater than or equal to 0.5 μm, inorganic particles in the dispersion liquid can sink more easily, and toner filming can occur.

When the amount of inorganic particles added to the surface layer 93 is large, abrasion resistance is high, which is desirable. An extremely large amount of inorganic particles, however, causes side effects such as increases in residual potentials and decreases in the degree of transmission of writing light in the protective layer.

Accordingly, the amount of addition to the total solid amount is smaller than or equal to about 50% by weight, and more preferably smaller than or equal to 30% by weight. The lower limit is generally 5% by weight.

The above-described inorganic particles can be treated with at least one surface treatment agent, which is preferable for facilitating the dispersion of inorganic particles.

Decreases in dispersion of inorganic particles can cause, in addition to the rise of residual potentials, degradation of transparency of coating, defective coating, and further degradation of abrasion resistivity. Accordingly, the decrease in dispersion of inorganic particles can hinder the extension of operational life or image quality improvement.

Typical surface treatment agents can be used, but surface treatment agents capable of maintaining insulation of inorganic particles are preferable.

For example, titanate coupling agents, aluminum coupling agents, zircoaluminate coupling agents, higher fatty acids, mixtures of silane coupling agents and those, $Al_2O_3$, $TiO_2$, $ZrO_2$, silicone, aluminum stearate, and mixtures of two or greater of them are preferable as the surface treatment agent to attain preferable dispersion of inorganic particles and inhibition of image blurring.

Although treatment with silane coupling agents increases image blurring effects, the effects may be inhibited by mixing the above-described surface treatment agents in the silane coupling agent.

The amount of surface treatment agent is preferably from 3% by weight to 30% by weight, and, more preferably, from 5% by weight to 20% by weight although the amount of surface treatment agent depends on the average primary particle diameter of inorganic particle. If the amount of surface treatment is smaller than this range, dispersion of inorganic particles is insufficient, and, if the amount is extremely large, the residual potential can rise significantly. The above-mentioned inorganic particles can be used alone or in combination.

The above-mentioned inorganic particles can be dispersed using a dispersing device. The average particle diameter of the inorganic particles in the dispersion liquid is preferably smaller than or equal to 1 μm and, more preferably, smaller than or equal to 0.5 μm considering the transmittance of the surface layer 93.

Next, toner usable in the image forming apparatus 100 according to the present embodiment is described below using drawings.

Figure 7A:
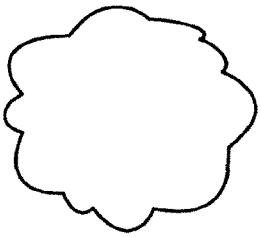
FIGS. 7A and 7B are illustrations of measurement of circularity of toner.
Figure 7B:
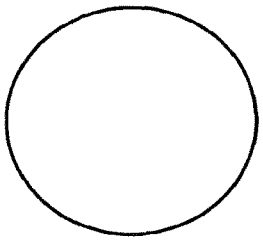

FIGS. 7A and 7B are illustrations of measurement of circularity of toner. FIG. 7A schematically illustrates a peripheral length C1 of a projected shape of a toner particle having a projected area S. FIG. 7B illustrates a peripheral length C2 of a perfect circle having an area identical to the area (area S) of the projected shape illustrated in FIG. 7A.

To improve image quality, it is preferable to use polymerization toner produced by suspension polymerization, emulsion polymerization, or dispersion polymerization, which is suitable for enhancing circularity and reducing particle diameter. Particularly preferable is use of polymerization toner having a circularity of greater than or equal to 0.97 and a volume average particle diameter of smaller than or equal to 5.5 μm. High resolution can be attained by use of polymerization toner having a circularity of greater than or equal to 0.97 and a volume average particle diameter of smaller than or equal to 5.5 μm.

The circularity used herein is an average circularity measured by a flow-type particle image analyzer FPIA-2000 from SYSMEX CORPORATION. The average circularity is measured as follows. Put surfactant as a dispersant, preferably 0.1 ml to 0.5 ml of alkylbenzene sulfonate, in 100 ml to 150 ml of water from which impure solid materials are previously removed, and add 0.1 g to 0.5 g of the sample (toner) to the mixture. Then, disperse the mixture including the toner with an ultrasonic disperser for 1 to 3 minutes to prepare a dispersion liquid having a concentration of from 3,000 to 10,000 pieces/μl, and measure the toner shape and distribution with the above-mentioned measurer.

Based on the measurement results, obtain C2/C1 where C1 represents the peripheral length of the projected toner particle having the area S illustrated in FIG. 7A, and C2 represents the peripheral length of the perfect circle illustrated in FIG. 7B, having the area S similar to the projected toner particle illustrated in FIG. 7A. The average of C2/C1 is used as the circularity.

The volume average particle diameter of toner can be measured by a coulter counter method. Specifically, number distribution and volume distribution of toner, measured by Coulter Multi sizer 2e from Beckman Coulter, are output, via an interface from Nikkaki Bios Co., Ltd., to a computer and analyzed. More specifically, the volume average particle diameter of toner is obtained as follows. Prepare, as an electrolyte, a NaCl aqueous solution including a primary sodium chloride of 1%. Add 0.1 ml to 5 ml of surfactant, preferably alkylbenzene sulfonate, as dispersant, to 100 ml to 150 ml of the electrolyte. Add, as test sample, 2 mg to 20 mg of toner to the mixture and disperse the test sample by an ultrasonic disperser for 1 to 3 minutes.

Put 100 ml to 200 ml of the electrolyte solution in a separate beaker, and put the above-described sample therein to attain a predetermined concentration. Then, using Coulter Multisizer 2e, measure the particle diameter of 50,000 toner particles with an aperture of 100 μm.

The number of channels used in the measurement is thirteen. The ranges of the channels are from 2.00 μm to less than 2.52 μm, from 2.52 μm to less than 3.17 μm, from 3.17 μm to less than 4.00 μm, from 4.00 μm to less than 5.04 μm, from 5.04 μm to less than 6.35 μm, from 6.35 μm to less than 8.00 μm, from 8.00 μm to less than 10.08 μm, from 10.08 μm to less than 12.70 μm, from 12.70 μm to less than 16.00 μm, from 16.00 μm to less than 20.20 μm, from 20.20 μm to less than 25.40 μm, from 25.40 μm to less than 32.00 μm, from 32.00 μm to less than 40.30 μm. The target is toner particles of particle diameter greater than or equal to 2.00 μm and smaller than or equal to 32.0 μm. Calculate the volume average particle diameter represented as ΣXfV/ΣfV, where X represents a representative diameter in each channel, V represents an equivalent volume of the representative diameter in each channel, and f represents the number of particles in each channel.

Numerous additional modifications and variations are possible in light of the above teachings. It is therefore to be understood that, within the scope of the appended claims, the disclosure of this patent specification may be practiced otherwise than as the configurations including the cleaning blade 5 or the cleaning device 1 (or 1A) specifically described herein.

The various aspects of the present specification can attain specific effects as follows.

Aspect A

Aspect A concerns an elastic blade (e.g., the cleaning blade 5) that includes a contact edge (e.g., the edge 61) to contact a surface of a contact object (e.g., the photoconductor 10). On a cross section perpendicular to a direction in which the contact edge extends, the blade includes an edge region (e.g., the edge region 6) and a backup region (e.g., the backup region 7 or another region) different in at least one of material and property from the edge region. The edge region includes a layer-like portion including the contact edge and having a thickness (e.g., the thickness t illustrated in FIGS. 3A through 3D) smaller than or equal to 0.5 mm. The blade has a converted Martens hardness in a range of from 0.9 to 2.9 (N/mm$^2$). The converted Martens hardness is defined as:

$$X = \frac{S_A}{S_A + S_B} \times h_A + \frac{S_B}{S_A + S_B} \times h_B \qquad \text{Formula 1}$$

where X represents the converted Martens hardness (N/mm$^2$), $S_A$ represents the cross-sectional area (mm$^2$) of the edge region, $S_B$ represents the cross-sectional area (mm$^2$) of the backup region, $h_A$ represents the Martens hardness (N/mm$^2$) of the edge region, $h_B$ represents the Martens hardness (N/mm$^2$) of the backup region, and t represents the thickness of the layer-like portion including the contact edge to oppose the contact object.

The converted Martens hardness X defined by Formula 1 serves as an index of hardness of the entire blade having the two-region structure.

When the converted Martens hardness X is greater than or equal to 0.9 N/mm$^2$ and smaller than or equal to 2.9 N/mm$^2$, the hardness of the entire cleaning blade 5 can be in a preferable range to suppress the degradation of the capability of the blade to follow the contact object and the fatigue over time of the blade. Additionally, the hardness of the blade can be in the range to suppress the risk of chipping of the contact edge of the blade due to stick-slip of the contact edge.

Further, when the thickness t of the layer-like portion including the contact edge is smaller than or equal to 0.50 mm, the risk of the fatigue of the blade is reduced.

Aspect A inhibits the substances, such as the residual toner, from passing between the contact object and the contact edge of the blade and accordingly inhibits the degradation of the capability to remove the residual substances on the contact object.

Aspect B

In Aspect A, the Martens hardness $h_A$ of the edge region is greater than the Martens hardness $h_B$ of the backup region.

As described in the embodiments, when the edge region has a higher hardness than the hardness of another region (e.g., the backup region 7), escaping residual substances as well as chipping of the contact edge due to the stick-slip can be inhibited.

Aspect C

In Aspect A or B, the Martens hardness $h_A$ of the edge region is greater than or equal to 1.5 N/mm$^2$.

As described in the embodiments, when the Martens hardness $h_A$ of the edge region is greater than or equal to 1.5 N/mm$^2$, the occurrence of image failure such as streaky voids and filming caused by the adhering substances, which solidifies on the photoconductor 10 over time, is inhibited.

Aspect D

In Aspect A or C, the Martens hardness $h_B$ of the backup region is in a range of from 0.5 N/mm$^2$ to 2.0 N/mm$^2$.

As described in the embodiments, when the Martens hardness $h_B$ of the backup region is in the range of from 0.5 N/mm$^2$ to 2.0 N/mm$^2$, escaping of the substances as well as wear and chipping of the contact edge are suppressed.

Aspect E

In any one of Aspects A through D, a blade holder is attached to the blade to support the blade, and the edge region extends along the circumference of the blade except the portion (e.g., the connected area 70) connected to the blade holder, on the cross section perpendicular to the direction in which the contact edge extends (Blade type illustrated in FIG. 3A). The blade has an end face and an opposing face adjacent to the end face via the contact edge. The layer-like portion is disposed on the opposing face, and the thickness t of the layer-like portion is in a range of from 0.05 mm to 0.20 mm.

As described in the embodiments, when the thickness t of the layer-like portion including the contact edge of Blade type 1 (illustrated in FIG. 3A) is in the range of from 0.05 mm to 0.20 mm, the backup region is inhibited from being exposed, and the fatigue of the cleaning blade 5 is inhibited. Accordingly, degradation of cleaning capability is alleviated.

Aspect F

In any one of Aspects A through D, on the cross section perpendicular to the direction in which the contact edge extends, the edge region extends along the opposing face (i.e., Blade type 2 illustrated in FIG. 3B). The thickness t of the edge region including the contact edge is in a range of from 0.05 mm to 0.50 mm.

As described in the embodiments, when the thickness t of the edge region including the contact edge of Blade type 2 (illustrated in FIG. 3B) is in the range of from 0.05 mm to 0.50 mm, the backup region is inhibited from being exposed, and the fatigue of the cleaning blade 5 is inhibited. Accordingly, degradation of cleaning capability is alleviated.

Aspect G

In any one of Aspects A through D, on the cross section perpendicular to the direction in which the contact edge extends, the edge region including the contact edge extends along the end face (e.g., Blade type 3 illustrated in FIG. 3C). The thickness t of the layer-like portion including the contact edge is in a range of from 0.05 mm to 0.20 mm.

As described in the embodiments, when the thickness t of the layer-like portion including the contact edge of Blade type 3 is in the range of from 0.05 mm to 0.20 mm, the backup region is inhibited from being exposed, and the fatigue of the cleaning blade 5 is inhibited. Accordingly, degradation of cleaning capability is alleviated.

Aspect H

In any one of Aspects A through D, on the cross section perpendicular to the direction in which the contact edge extends, the edge region including the contact edge is a triangular region defined by the edge 61, a point on the end face, and a point on the opposing face (i.e., Blade type 4 illustrated in FIG. 3D). The thickness t is a length along the end face 63 on the cross section perpendicular to the direction in which the edge 61 extends, and the thickness t is in a range of from 0.05 mm to 0.50 mm.

As described in the embodiments, when the thickness t of the triangular edge region including the contact edge of Blade type 4 is in the range of from 0.05 mm to 0.50 mm, the backup region is inhibited from being exposed, and the fatigue of the cleaning blade 5 is inhibited. Accordingly, degradation of cleaning capability is alleviated.

Aspect I

Aspect I concerns a cleaning device that includes the blade according to any one of Aspects A through H to remove a residual substance from the contact object (e.g., the photoconductor 10). The cleaning device includes a spring (e.g., the spring 81) to press the contact edge toward the contact object (i.e., spring pressurizing).

As described in the embodiments, such spring pressurizing inhibits decreases in the line pressure of the edge 61 abutting against the photoconductor 10 even if the fatigue of the cleaning blade 5 occurs. That is, the line pressure can be kept almost constant, and defective cleaning is inhibited, thereby inhibiting defective cleaning.

Aspect J

An image forming apparatus includes an image bearer (e.g., the photoconductor 10) to bear an image, a charger (e.g., the charging device 40) to charge a surface of the image bearer, an exposure device (e.g., the exposure device 140) to expose the charged surface of the image bearer to form an electrostatic latent image on the image bearer, a developing device (e.g., the developing device 50) to develop the electrostatic latent image into a toner image, a transfer device (e.g., the secondary transfer roller 165) to transfer the toner image onto a recording medium, a fixing device (e.g., the fixing device 30) to fix the toner image on the recording medium, and a cleaning device 1 to remove a residual substances such as residual toner from the image bearer. The cleaning device includes the blade according to any one of Aspects A through H. Alternatively, the cleaning according to Aspect His used.

As described in the embodiments, with this configuration, the image forming apparatus can attain effects similar to those attained by any one of aspects A through H.

For example, the image forming apparatus can clean the image bearer preferably after the image transfer to inhibit the occurrence of image failure caused by defective cleaning.

What is claimed is:

1. An elastic blade comprising:

a contact edge to contact a contact object;

an edge region including the contact edge and having a thickness (t) smaller than or equal to 0.50 mm; and a backup region different in material or property from the edge region, the backup region adjacent to the edge region on a cross section perpendicular to a direction in which the contact edge extends, the elastic blade having a converted Martens hardness in a range of from 0.9 to 2.9, the converted Martens hardness defined as:

$$X = \frac{S_A}{S_A + S_B} \times h_A + \frac{S_B}{S_A + S_B} \times h_B$$

where X represents the converted Martens hardness in newtons per square millimeter, $S_A$ represents a cross-sectional area, perpendicular to the direction in which the contact edge extends, in square millimeters of the edge region of the entire blade, $S_B$ represents a cross-sectional area, perpendicular to the direction in which the contact edge extends, in square millimeters of the backup region of the entire blade, $h_A$ represents a Martens hardness in newtons per square millimeter of the edge region, $h_B$ represents a Martens hardness in newtons per square millimeter of the backup region, and t represents the thickness in millimeters of the edge region including the contact edge.

2. The elastic blade according to claim 1, wherein the Martens hardness ($h_A$) of the edge region is greater than the Martens hardness ($h_B$) of the backup region.

3. The elastic blade according to claim 1, wherein the Martens hardness ($h_A$) of the edge region is greater than or equal to 1.5 N/mm$^2$.

4. The elastic blade according to claim 1, wherein the Martens hardness ($h_B$) of the backup region is in a range of from 0.5 N/mm$^2$ to 2.0 N/mm$^2$.

5. The elastic blade according to claim 1, wherein the elastic blade includes:

an end face; and an opposing face adjacent to the end face via the contact edge and disposed opposing the contact object, wherein a blade holder is attached to the elastic blade to support the elastic blade, wherein, on the cross section perpendicular to the direction in which the contact edge extends, the edge region extends along a circumference of the elastic blade except a connected area connected to the blade holder, and wherein the thickness (t) of the edge region is in a range of from 0.05 mm to 0.20 mm on an opposing-face side.

6. The elastic blade according to claim 1, wherein the elastic blade includes:

an end face; and an opposing face adjacent to the end face via the contact edge and disposed opposing the contact object, wherein, on the cross section perpendicular to the direction in which the contact edge extends, the edge region extends along the opposing face, and wherein the thickness (t) of the edge region is in a range of from 0.05 mm to 0.50 mm.

7. The elastic blade according to claim 1, wherein the elastic blade includes:

an end face; and an opposing face adjacent to the end face via the contact edge and disposed opposing the contact object, wherein, on the cross section perpendicular to the direction in which the contact edge extends, the edge region extends along the end face, and wherein the thickness (t) of the edge region is in a range of from 0.05 mm to 0.20 mm.

8. The elastic blade according to claim 1, wherein the elastic blade includes:

an end face; and an opposing face adjacent to the end face via the contact edge and disposed opposing the contact object, wherein, on the cross section perpendicular to the direction in which the contact edge extends, the edge region is a triangular region defined by the contact edge, a point on the end face, and a point on the opposing face, and wherein a length of the edge region along the end face is in a range of from 0.05 mm to 0.50 mm.

9. A cleaning device comprising:

the elastic blade according to claim 1; and a spring to press the contact edge toward the contact object.

10. An image forming apparatus comprising:

an image bearer to bear an image;

a charger to charge a surface of the image bearer;

an exposure device to expose the surface of the image bearer which has been charged to form an electrostatic latent image on the image bearer;

a developing device to develop the electrostatic latent image into a toner image;

a transfer device to transfer the toner image from the image bearer onto a recording medium;

a fixing device to fix the toner image on the recording medium; and a cleaning device to remove residual toner from the image bearer, the cleaning device including the elastic blade according to claim 1.

11. The image forming apparatus according to claim 10, wherein the cleaning device includes a spring to press the contact edge of the elastic blade toward the image bearer.

* * * * *